US010843220B2

(12) United States Patent
Ikushima

(10) Patent No.: US 10,843,220 B2
(45) Date of Patent: Nov. 24, 2020

(54) LIQUID MATERIAL DISCHARGE DEVICE, APPLICATION DEVICE PROVIDED WITH SAME LIQUID MATERIAL DISCHARGE DEVICE, AND APPLICATION METHOD USING SAME APPLICATION DEVICE

(71) Applicant: MUSASHI ENGINEERING, INC., Tokyo (JP)

(72) Inventor: Kazumasa Ikushima, Mitaka (JP)

(73) Assignee: MUSASHI ENGINEERING, INC., Tokyo (JP)

( * ) Notice: Subject to any disclaimer, the term of this patent is extended or adjusted under 35 U.S.C. 154(b) by 317 days.

(21) Appl. No.: 15/025,373

(22) PCT Filed: Sep. 29, 2014

(86) PCT No.: PCT/JP2014/075789
§ 371 (c)(1),
(2) Date: Mar. 28, 2016

(87) PCT Pub. No.: WO2015/046481
PCT Pub. Date: Apr. 2, 2015

(65) Prior Publication Data

US 2016/0236228 A1 Aug. 18, 2016

(30) Foreign Application Priority Data

Sep. 30, 2013 (JP) ..... 2013-204578

(51) Int. Cl.
*B05C 5/02* (2006.01)
*B05D 1/26* (2006.01)

(52) U.S. Cl.
CPC ..... *B05C 5/0275* (2013.01); *B05C 5/0279* (2013.01); *B05D 1/26* (2013.01)

(58) Field of Classification Search
CPC ..... B05C 5/0275; B05C 5/0279; B05D 1/26; G02F 1/1341
See application file for complete search history.

(56) References Cited

U.S. PATENT DOCUMENTS 2,296,079 A * 9/1942 Anderson ..... B05B 7/066 239/118
3,213,587 A * 10/1965 Carruthers ..... B65B 1/363 53/435

(Continued)

FOREIGN PATENT DOCUMENTS

EP 1 867 399 A2 12/2007
EP 1972386 A1 * 9/2008 ..... B05C 5/0225

(Continued)

OTHER PUBLICATIONS

International Search Report dated Dec. 22, 2014, issued in counterpart International Application No. PCT/JP2014/075789 (2 pages).

(Continued)

*Primary Examiner* — Arthur O. Hall
*Assistant Examiner* — Steven M Cernoch
(74) *Attorney, Agent, or Firm* — Westerman, Hattori, Daniels & Adrian, LLP

(57) ABSTRACT

A discharge device includes a plunger unit (20) provided with three or more plungers (31), a plunger drive unit (60), a valve unit (40) including three or more metering bores (42) into which the plungers (31) are inserted, discharge ports (53) and a liquid material supply path (45) that are communicable with the metering bores (42), the valve unit (40) selectively taking a first position at which the metering bores (42) are communicated with the liquid material supply path (45) and a second position at which the metering bores (42) are communicated with the discharge ports (53), a valve drive unit (70) for switching over the valve unit (40) between the first and second positions, wherein the plunger (Continued)

holder (31) is detachably attached to the plunger drive unit (60) such that the number of the discharge ports and an interval therebetween can be changed depending on uses.

20 Claims, 21 Drawing Sheets

(56) References Cited

U.S. PATENT DOCUMENTS 3,557,820 A * 1/1971 Jackson ..... B29C 31/04 137/239
5,263,888 A * 11/1993 Ishihara ..... G02F 1/1341 349/190
5,265,804 A * 11/1993 Brunel ..... F02M 57/02 123/506
5,632,448 A * 5/1997 Alexander ..... B05B 3/1064 239/703
6,425,422 B1 * 7/2002 Trebbi ..... A61J 3/074 141/12
6,808,592 B1 * 10/2004 Rigali ..... H01J 37/32082 118/719
6,834,475 B2 * 12/2004 Trebbi ..... A61J 3/074 53/253
6,866,493 B2 * 3/2005 Trebbi ..... B30B 11/08 425/107
7,040,555 B2 * 5/2006 Miinalainen ..... B05C 5/0275 239/124
7,102,726 B2 * 9/2006 Byun ..... G02F 1/1303 349/189
7,153,118 B2 * 12/2006 Trebbi ..... B30B 11/08 425/107
7,677,016 B2 * 3/2010 Trebbi ..... A61J 3/074 53/253
8,950,445 B2 * 2/2015 Schlipf ..... A61J 3/074 141/146
2001/0035431 A1 * 11/2001 Runft ..... A61J 3/074 222/168.5
2004/0241317 A1 * 12/2004 Jung ..... G02F 1/1339 427/8
2006/0029724 A1 * 2/2006 Babiarz ..... B05C 11/1034 427/64
2006/0061727 A1 3/2006 Otani
2009/0236366 A1 * 9/2009 Ikushima ..... B67D 7/428 222/135

FOREIGN PATENT DOCUMENTS

JP 63-171665 A 7/1988
JP 9-220507 A 8/1997
JP 2002-361529 A 12/2002
JP 2004-160276 A 6/2004
JP 2006-84975 A 3/2006
JP 2008-136970 A 6/2008
JP 2010-232678 A 10/2010
WO 2007/046495 A1 4/2007
WO 2009/104421 A1 8/2009

OTHER PUBLICATIONS

Notification of Transmittal of Translation of the Internaltional Preliminary Report on Patentability (Form PCT/IPEA/409) issued in counterpart International Application No. PCT/JP2014/075789 dated Jan. 27, 2016. (19 pages).

* cited by examiner

[Fig. 1]
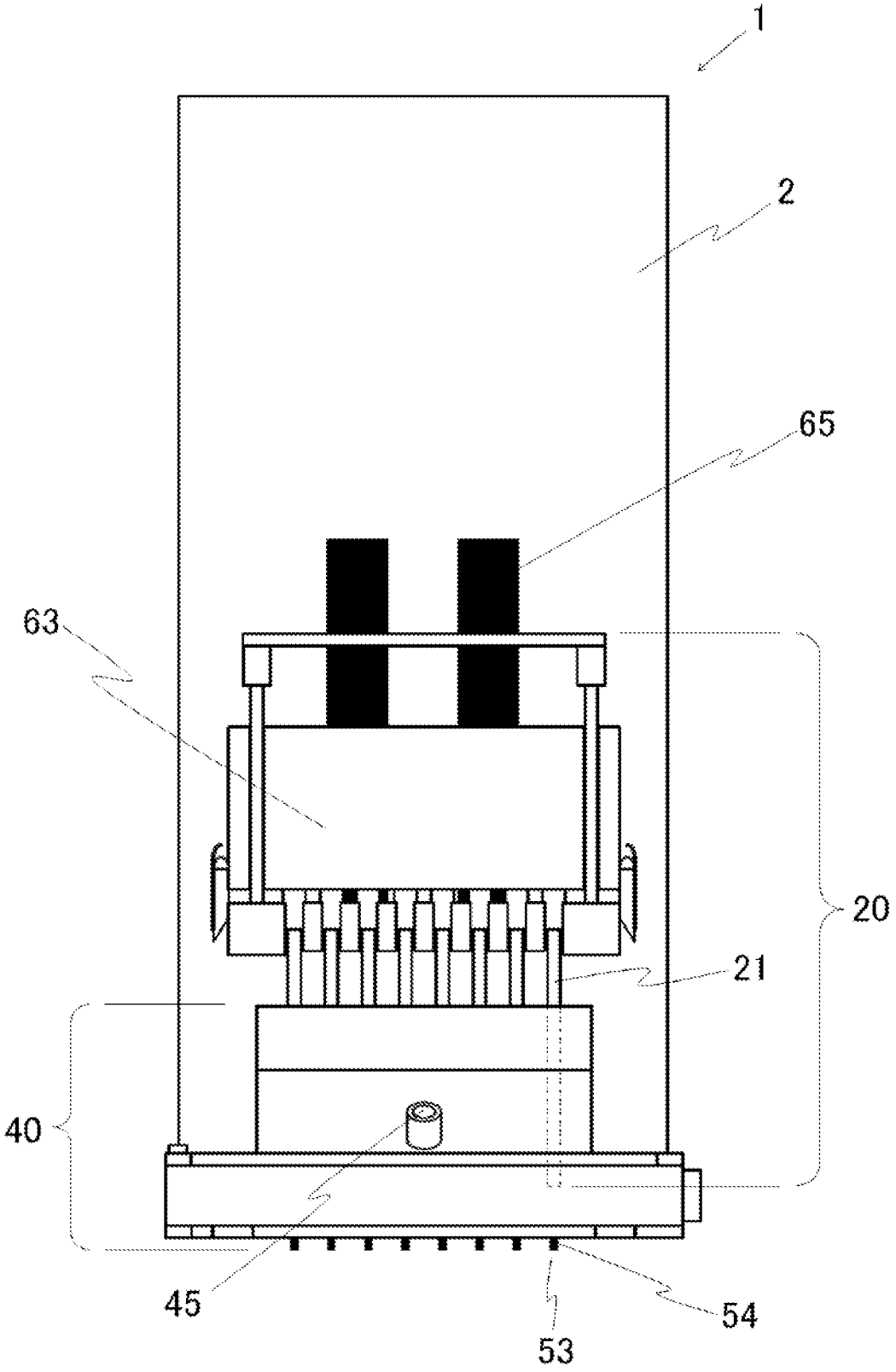

[Fig. 2]
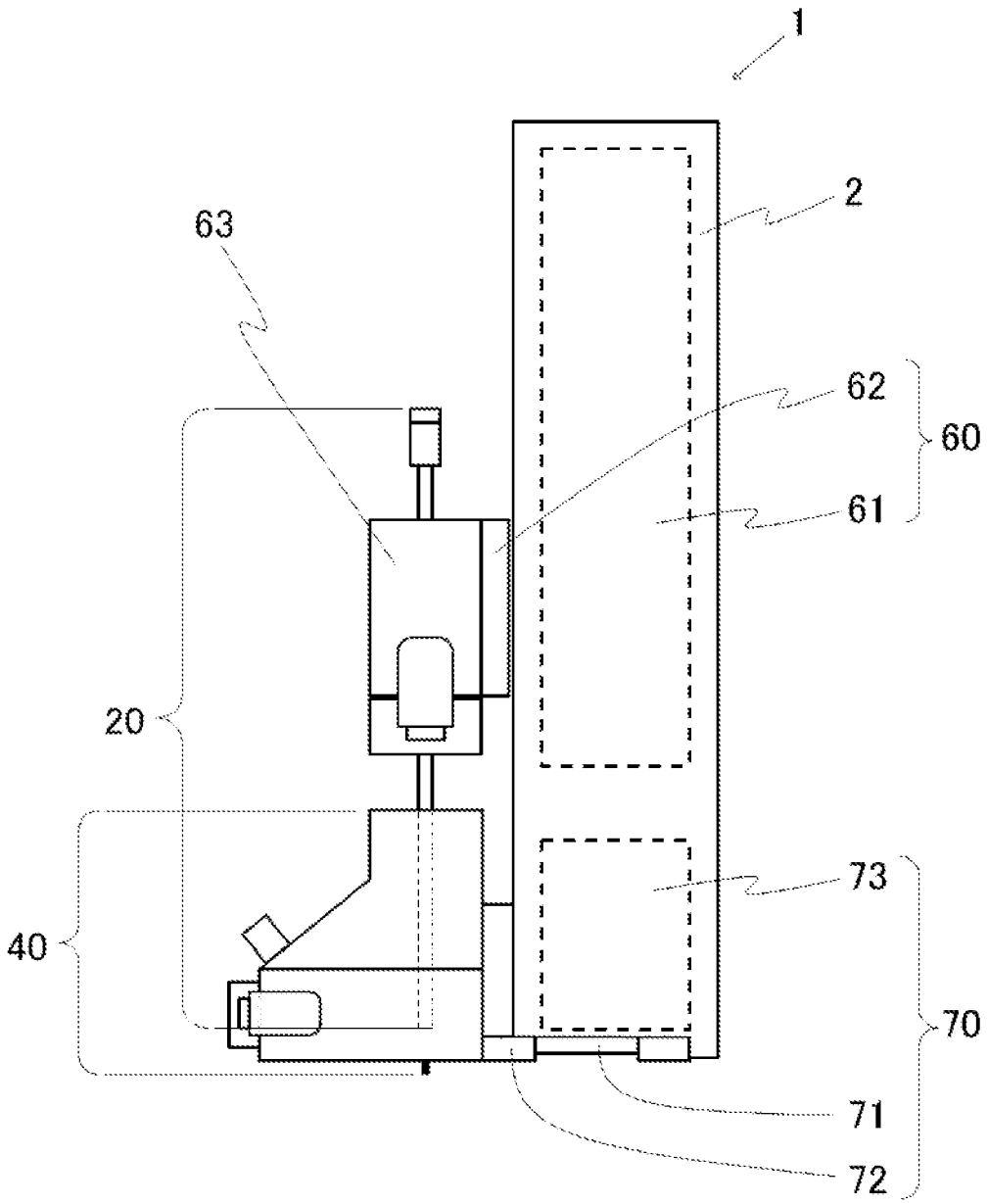

[Fig. 3]
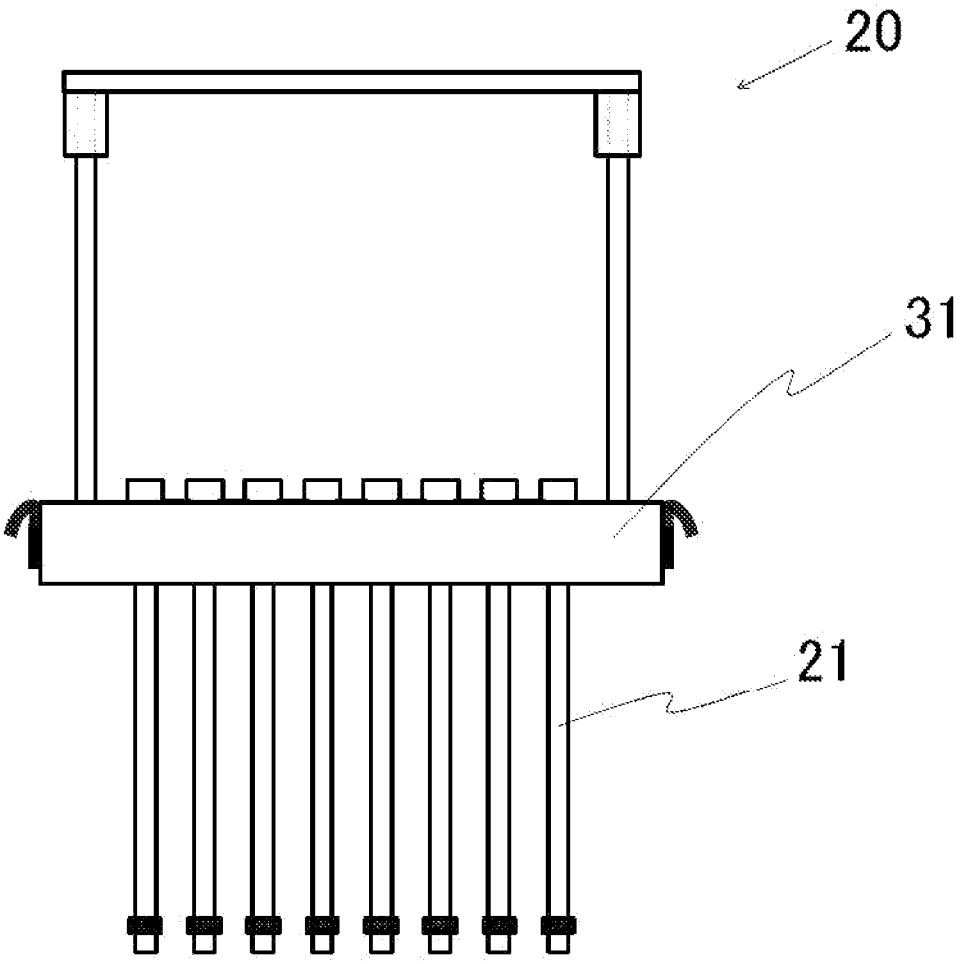

[Fig. 4]
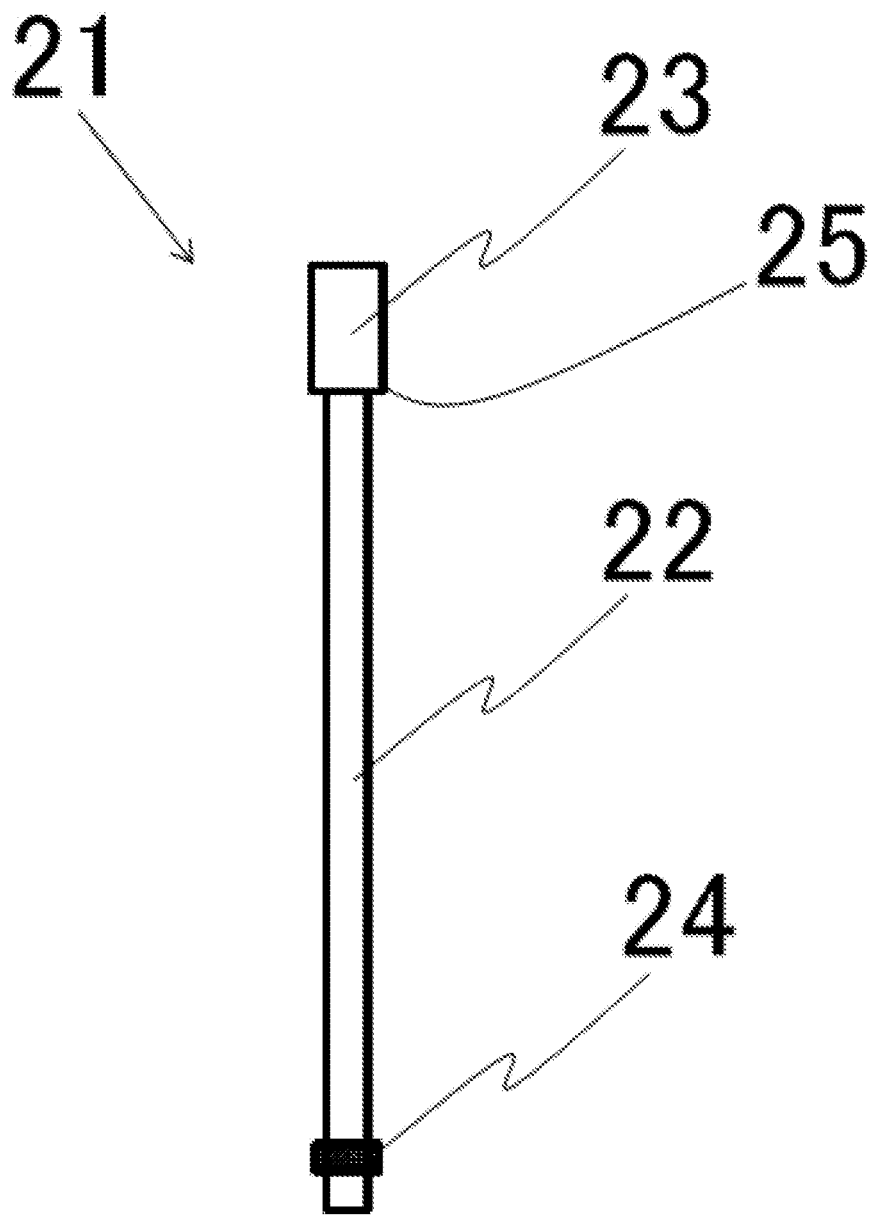

[Fig. 5]
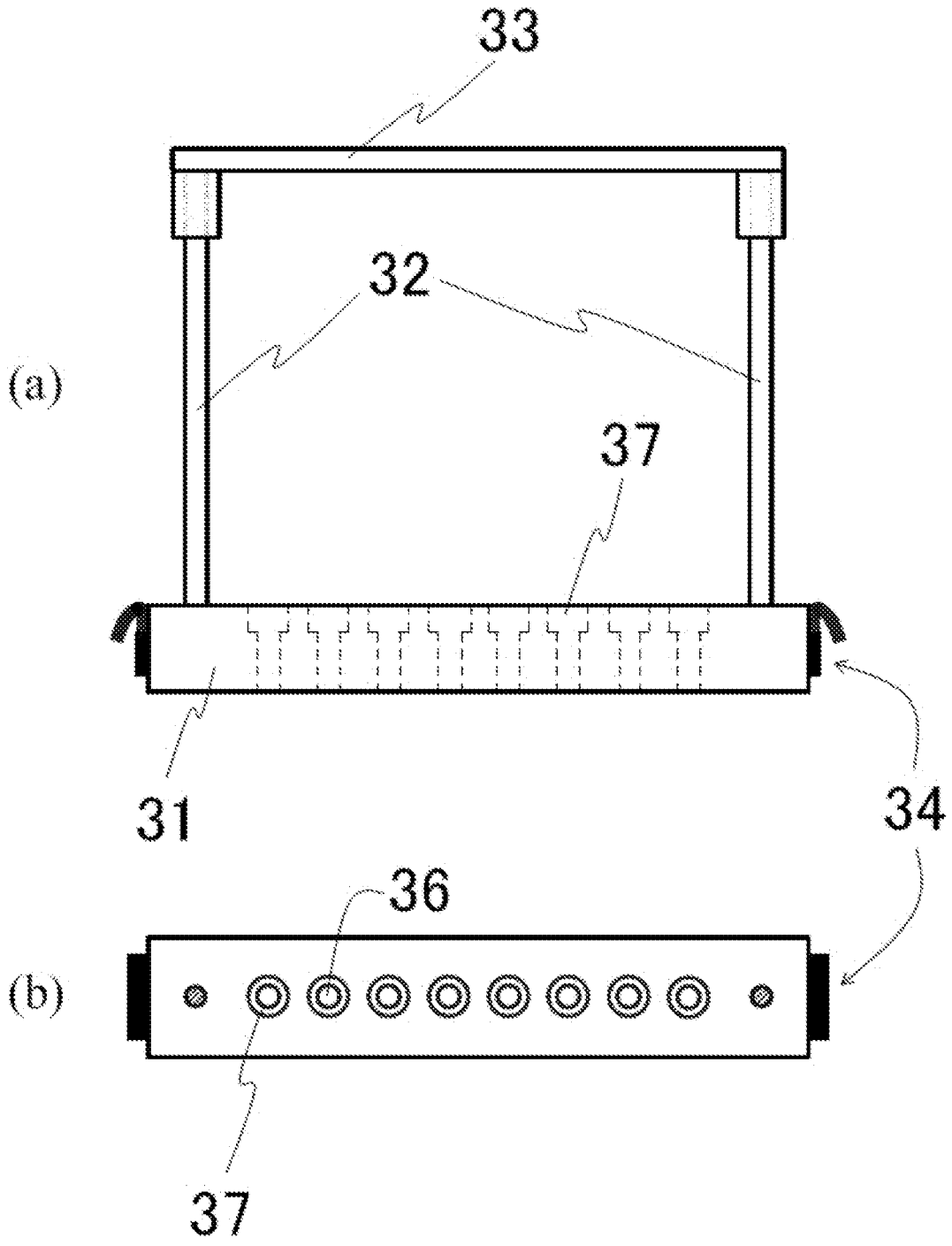

[Fig. 6]
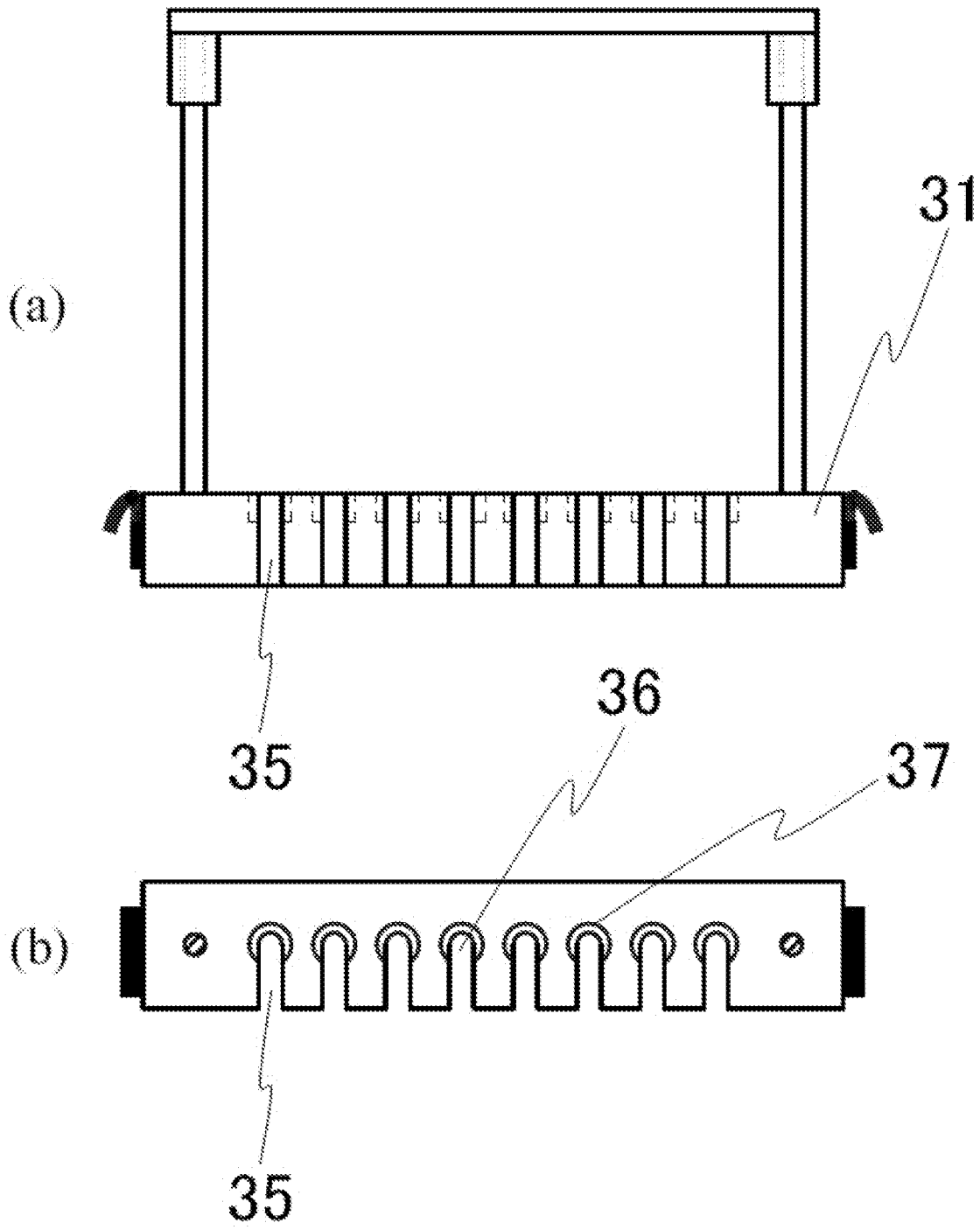

[Fig. 7]
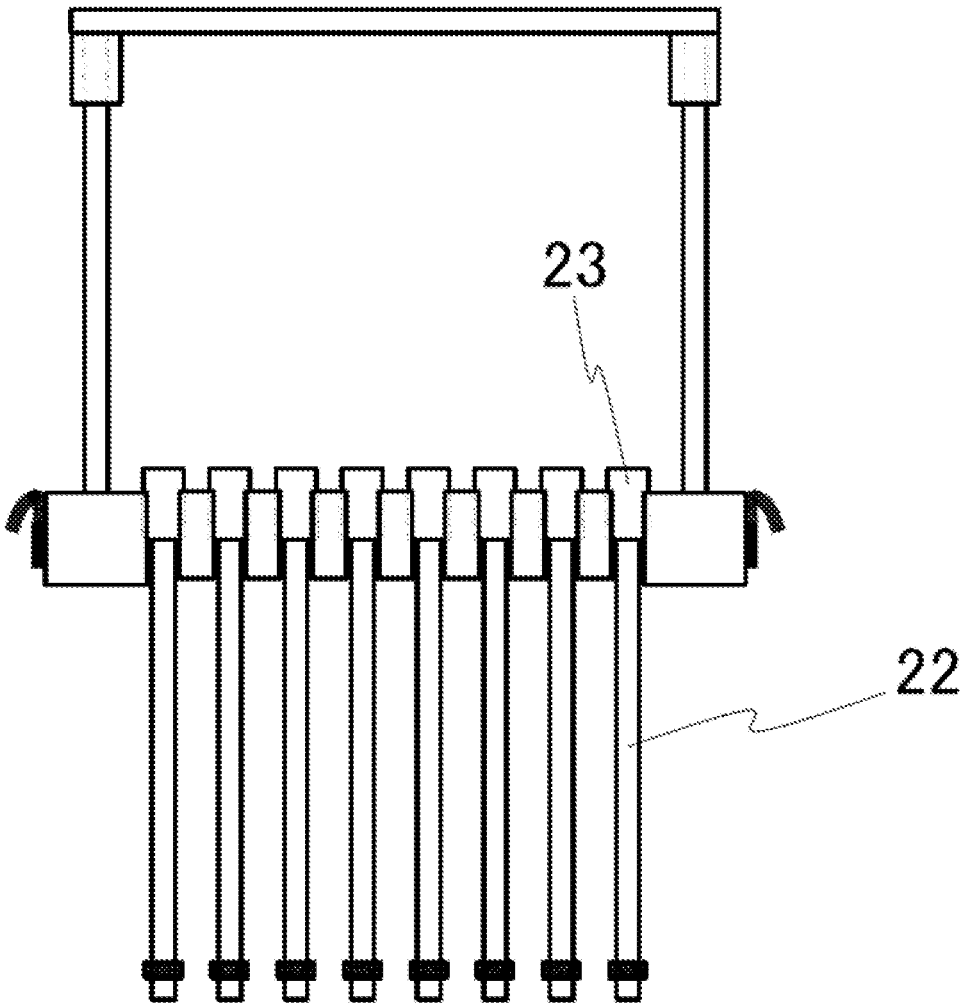

[Fig. 8]
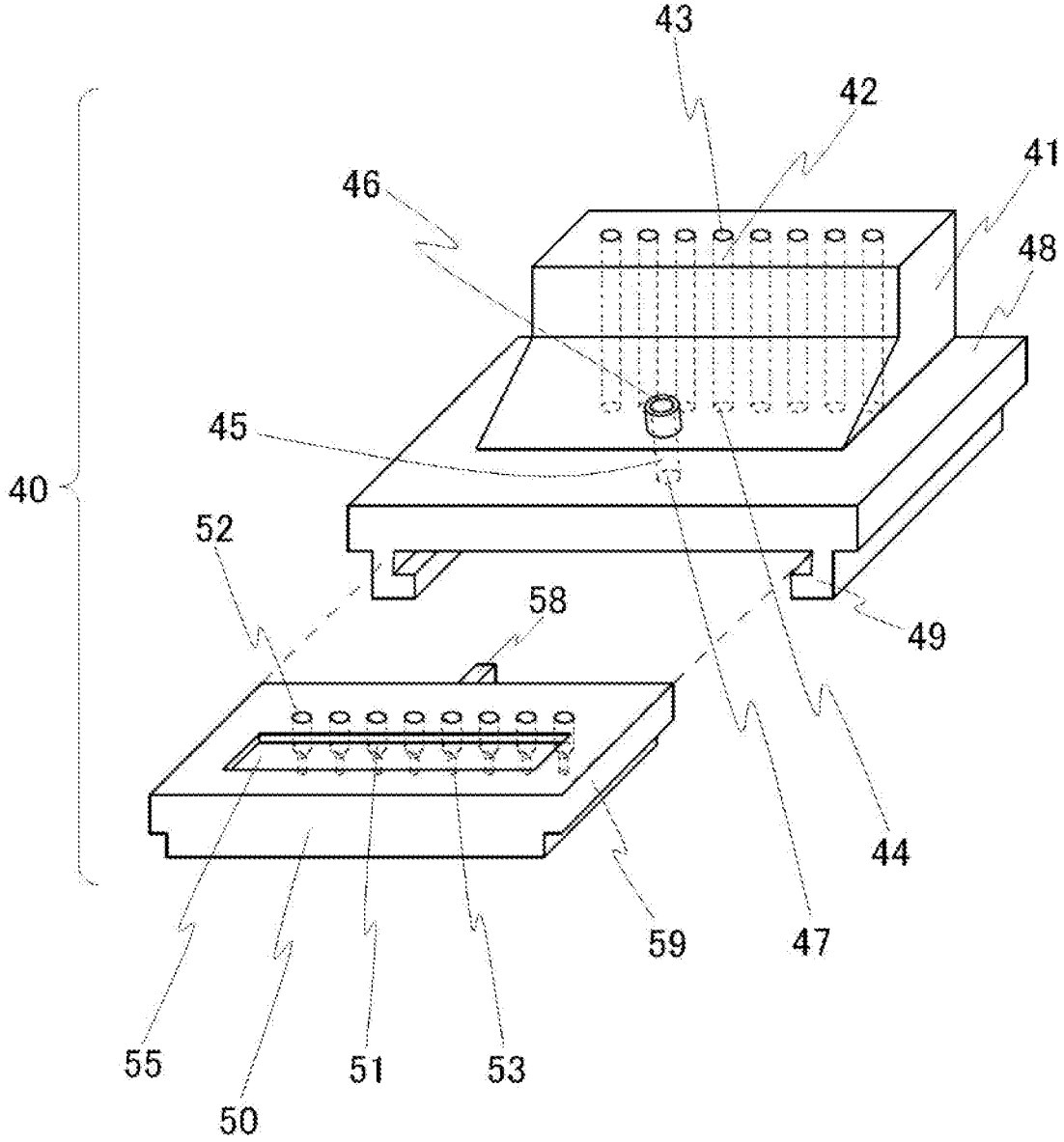

[Fig. 9]
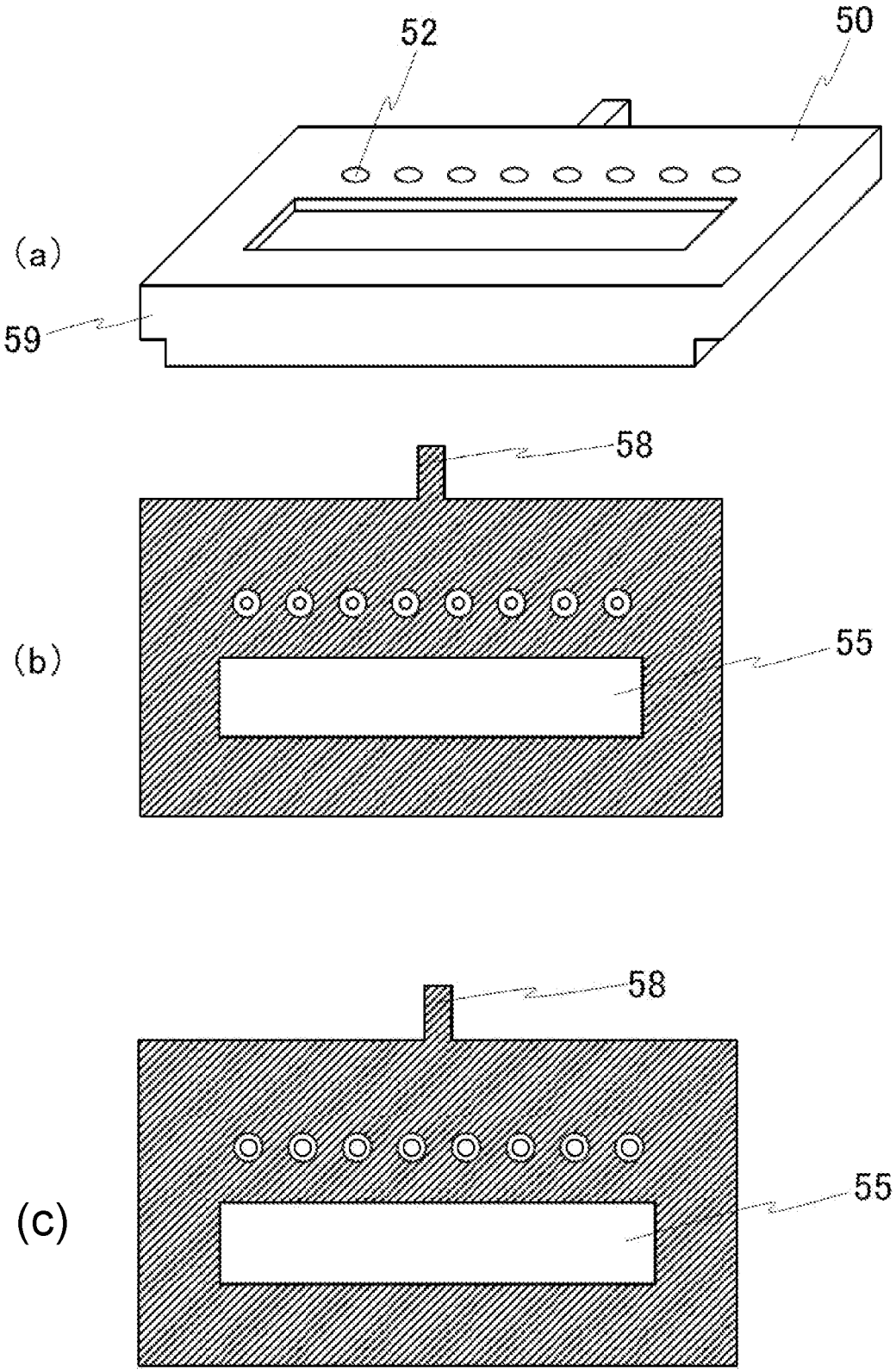

[Fig. 10]
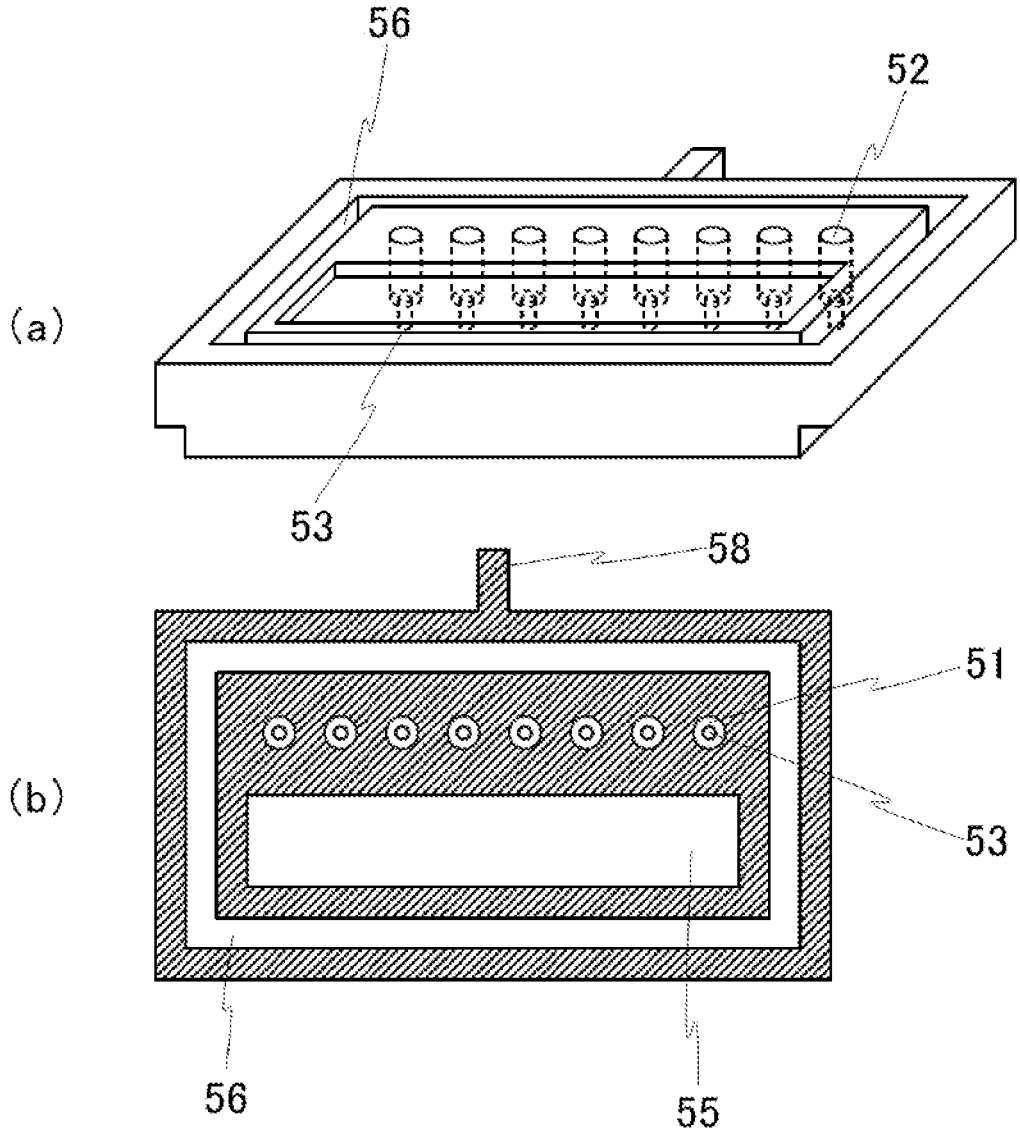

[Fig. 11]
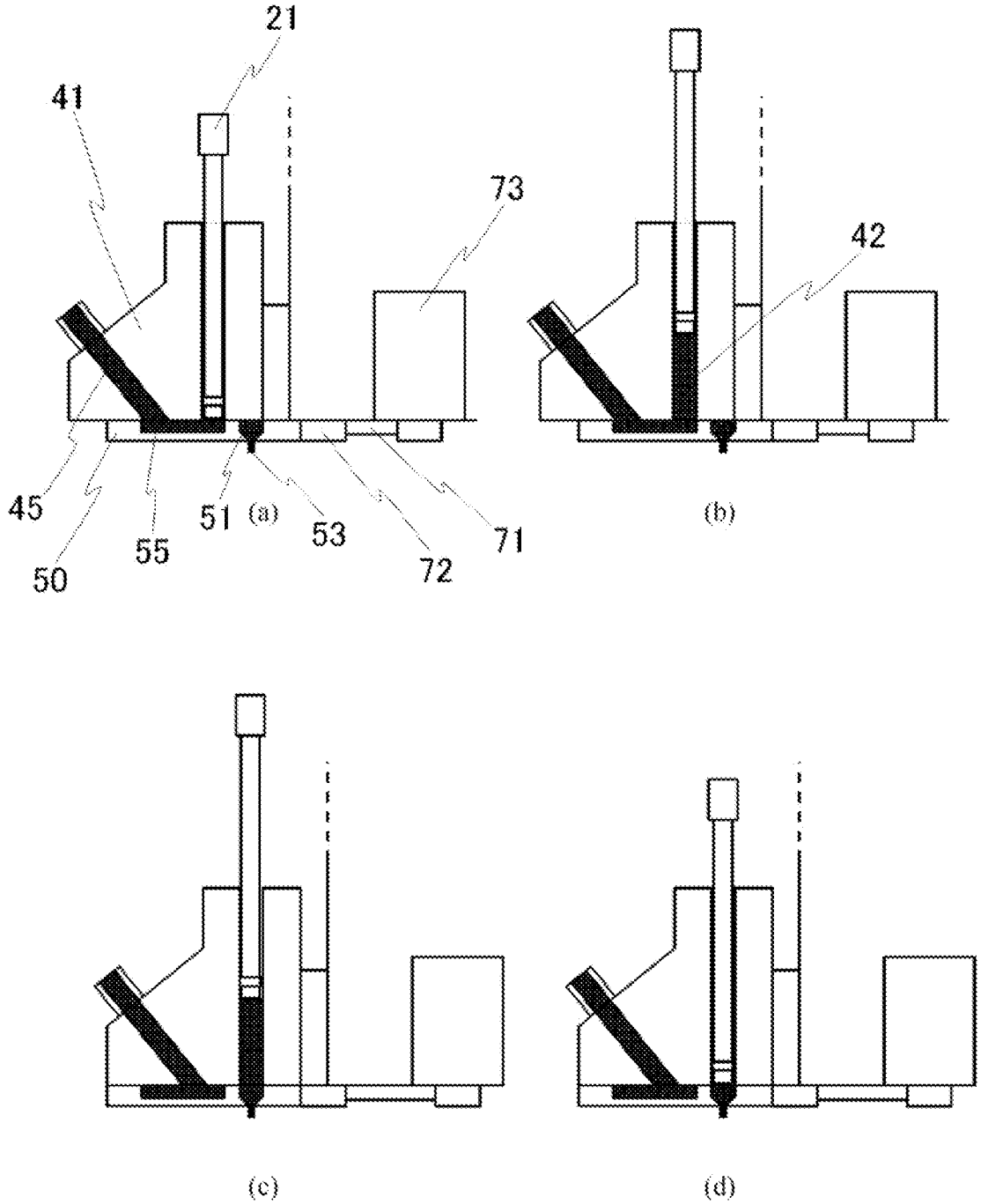

[Fig. 12]
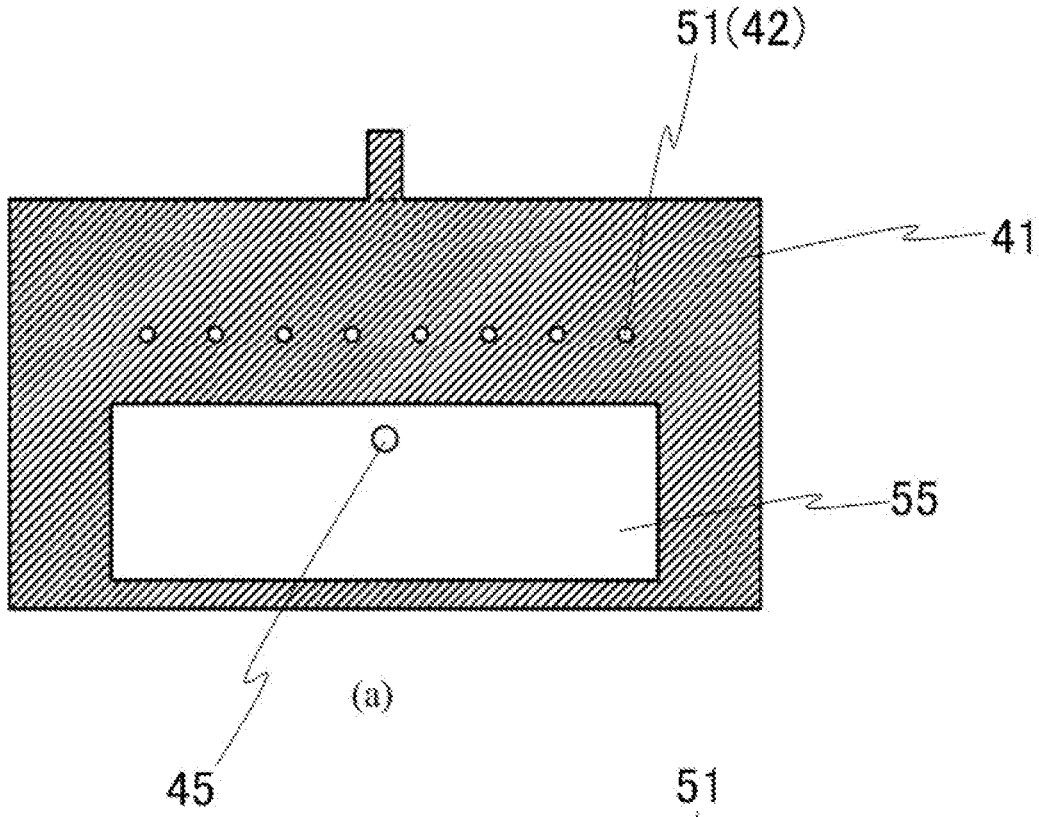
(a)
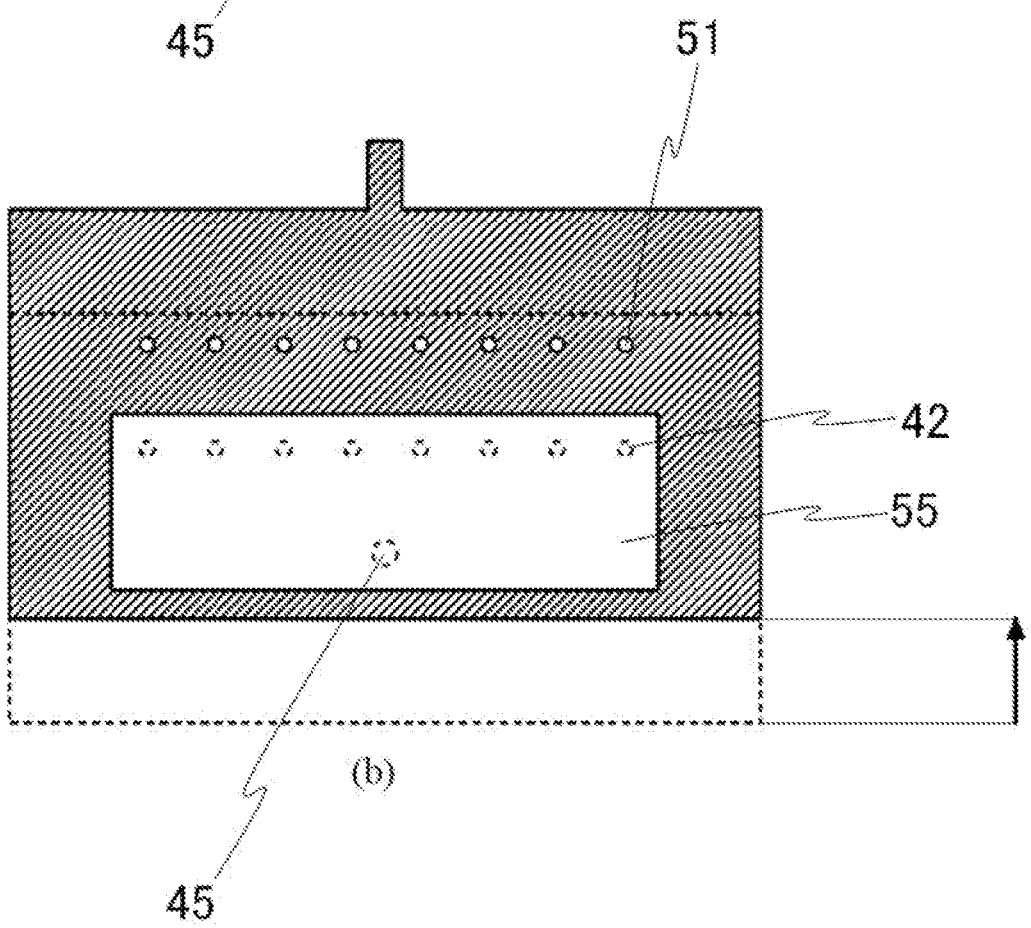
(b)

[Fig. 13]
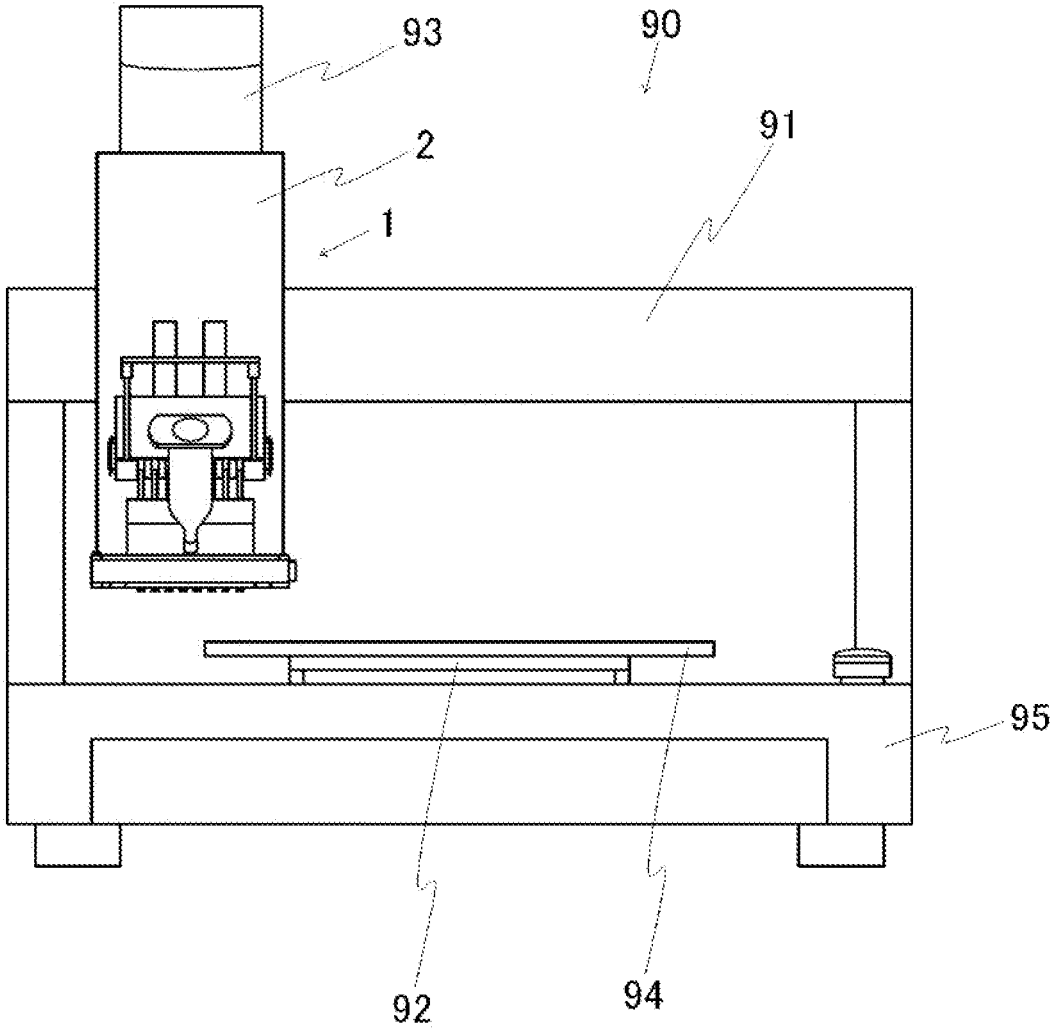

[Fig. 14]
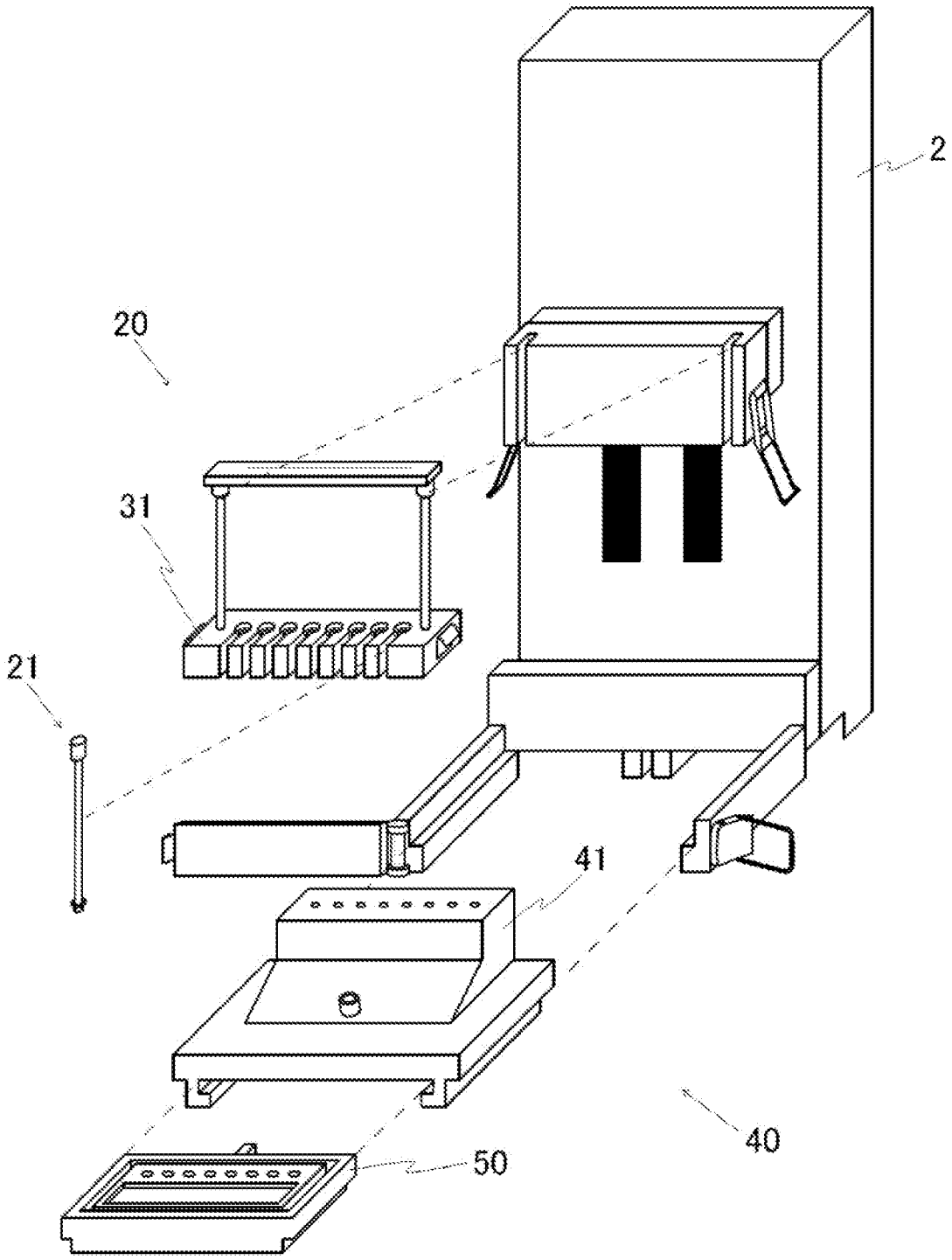

[Fig. 15]
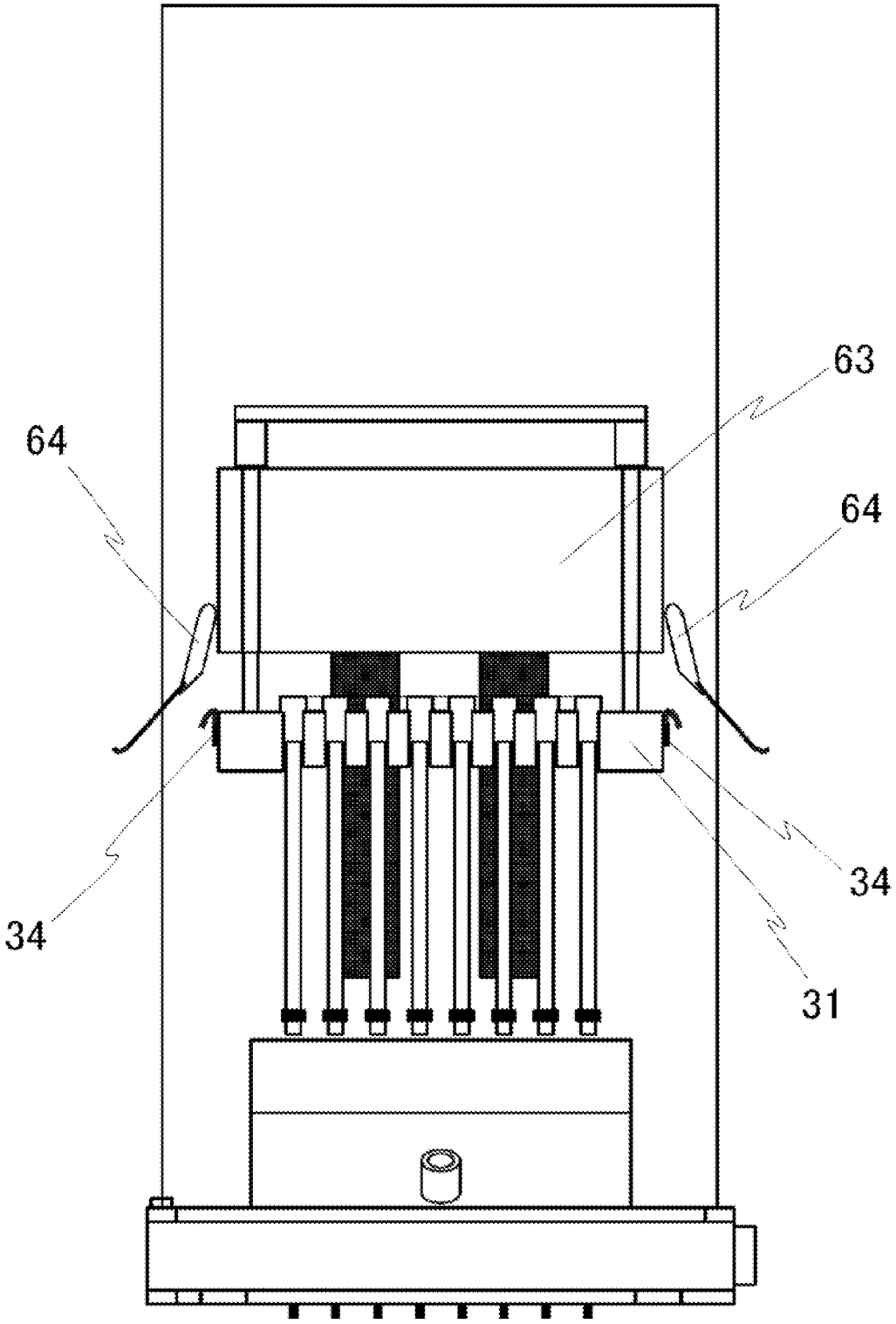

[Fig. 16]
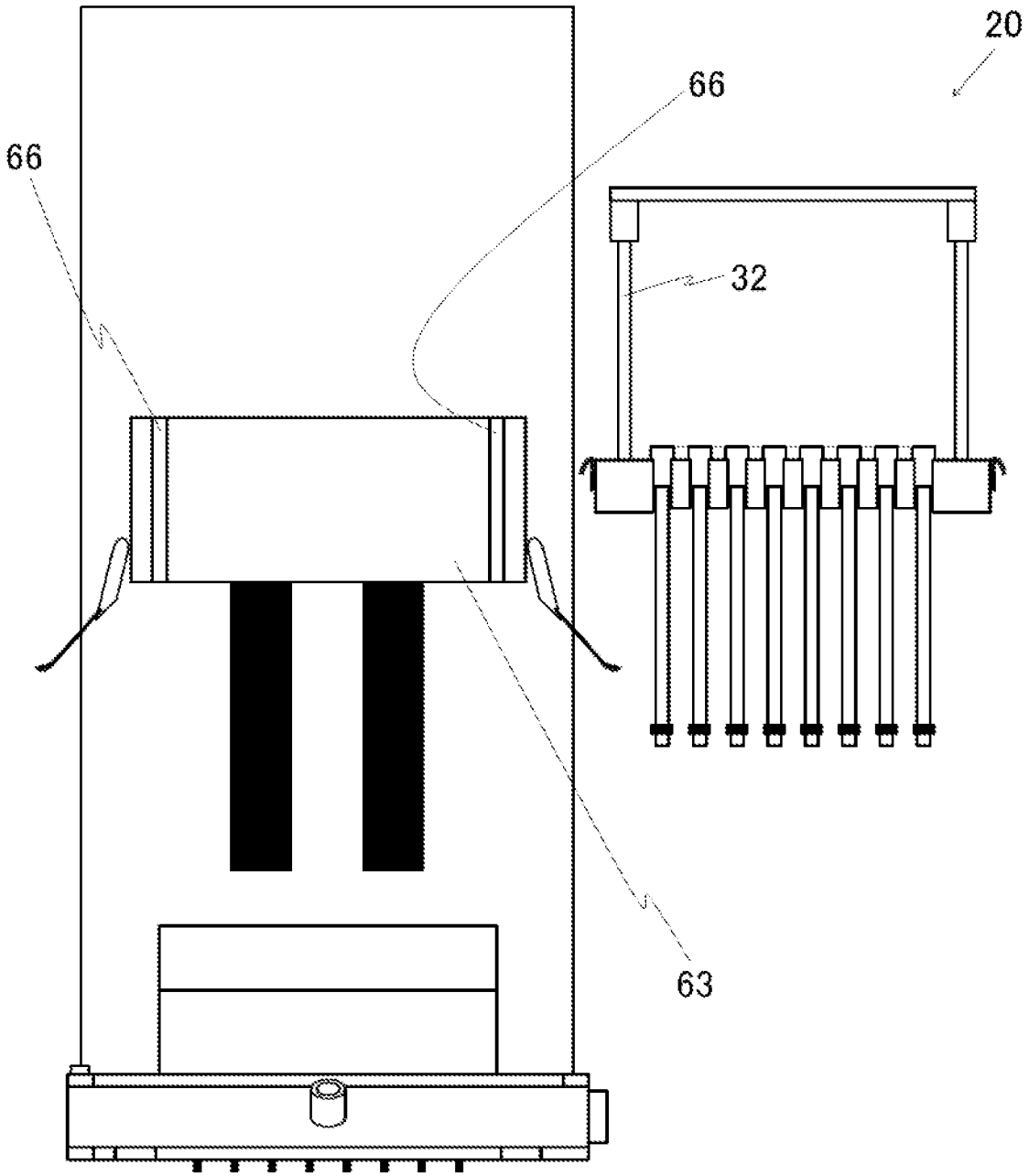

[Fig. 17]
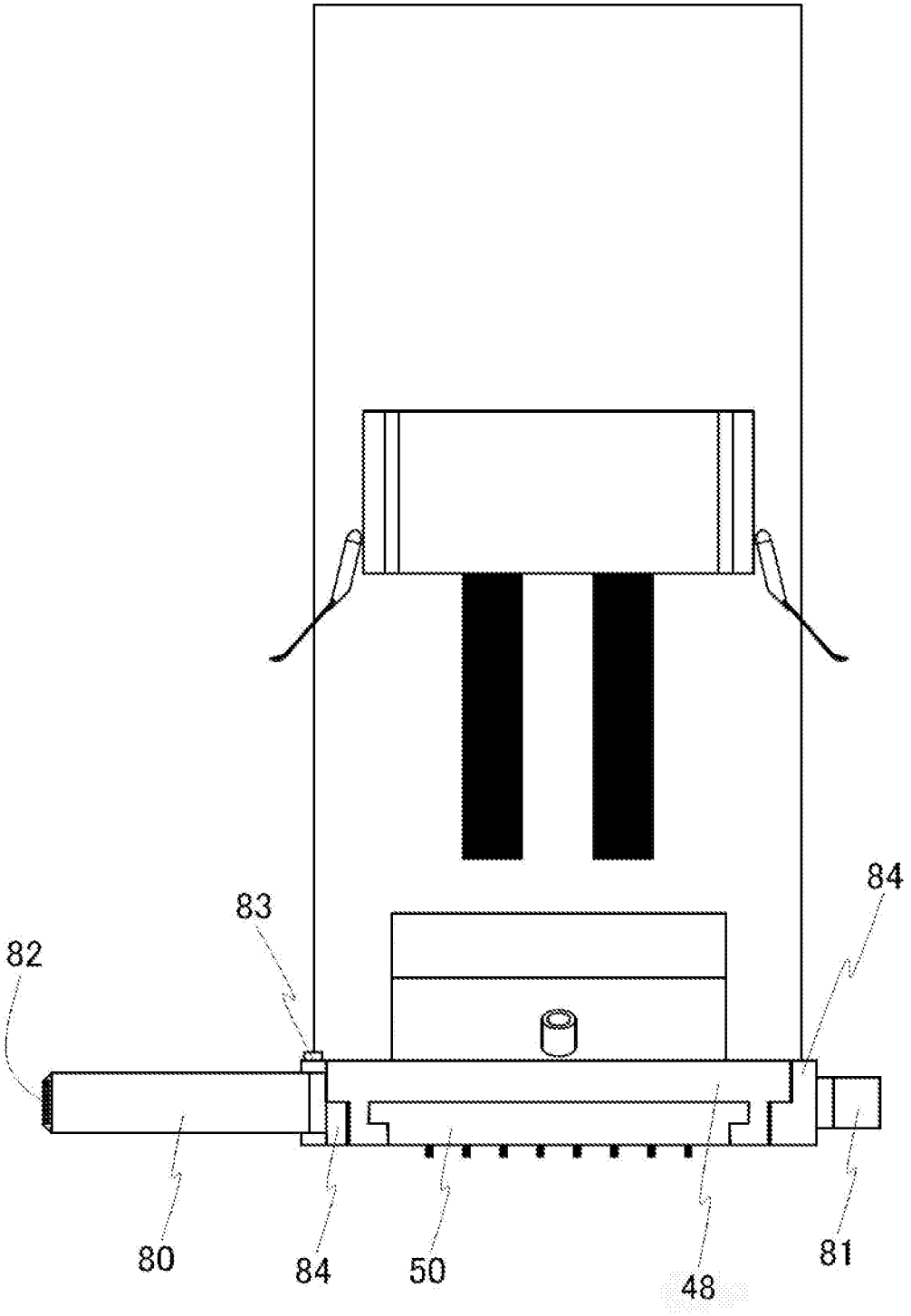

[Fig. 18]
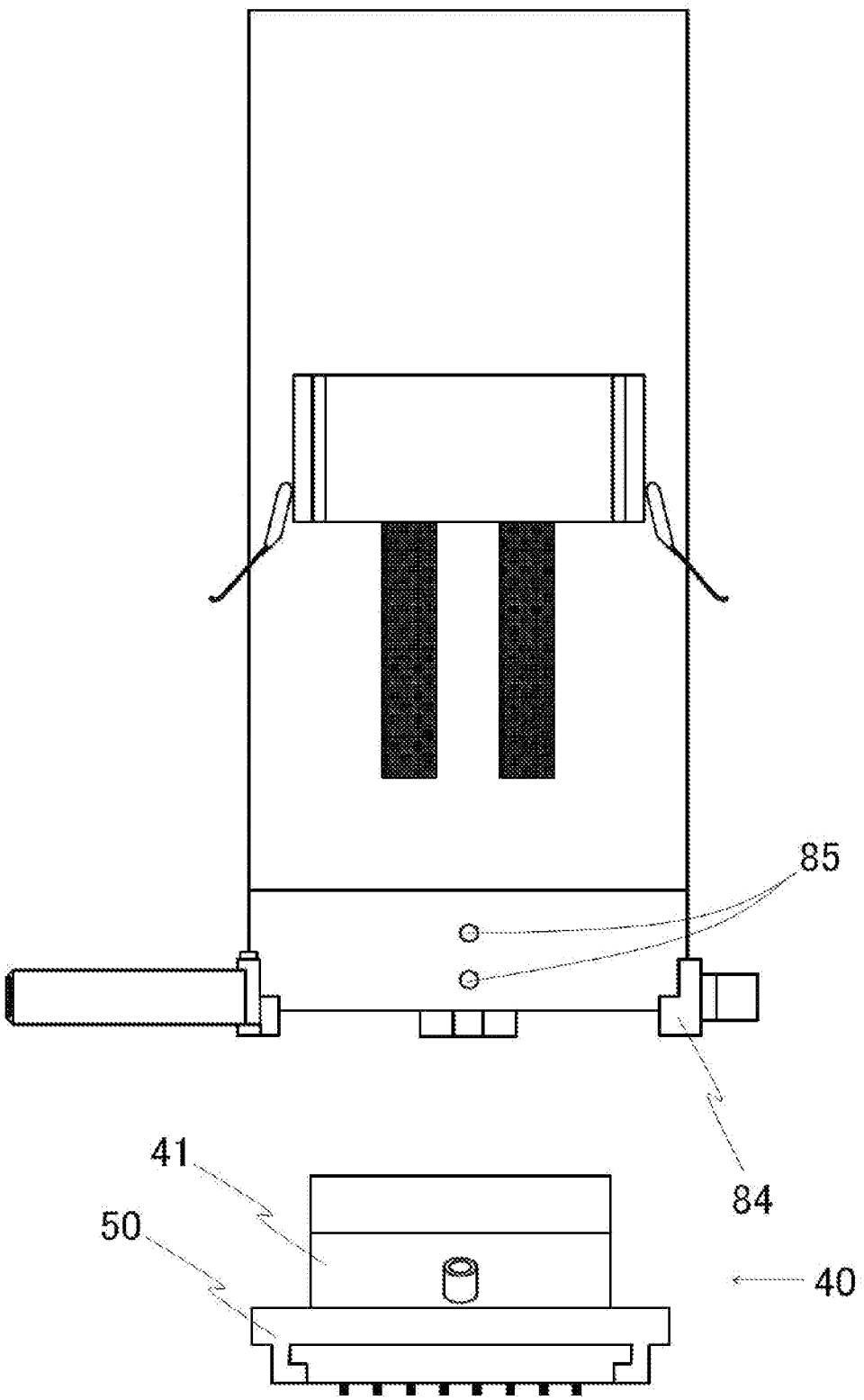

[Fig. 19]
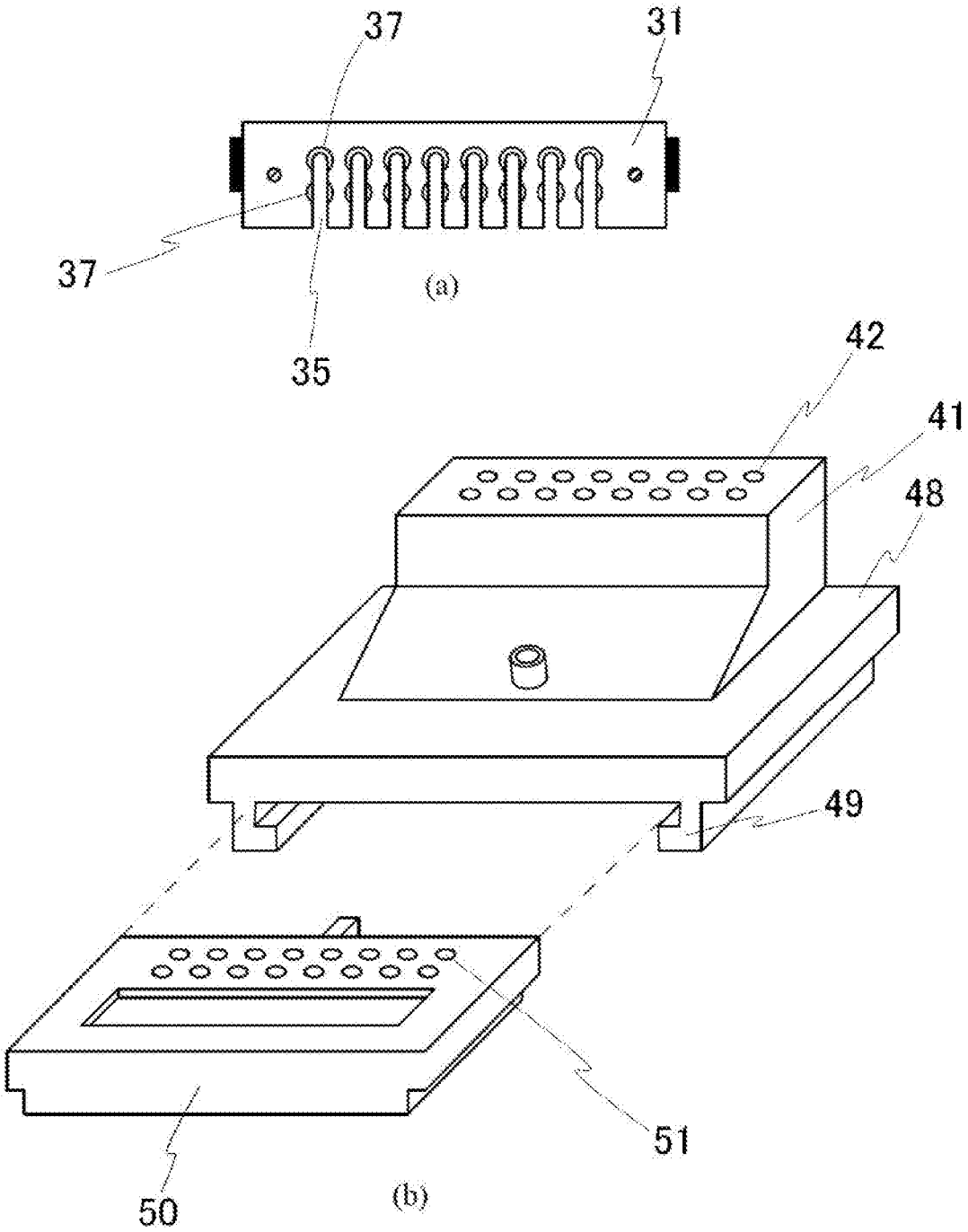

[Fig. 20]
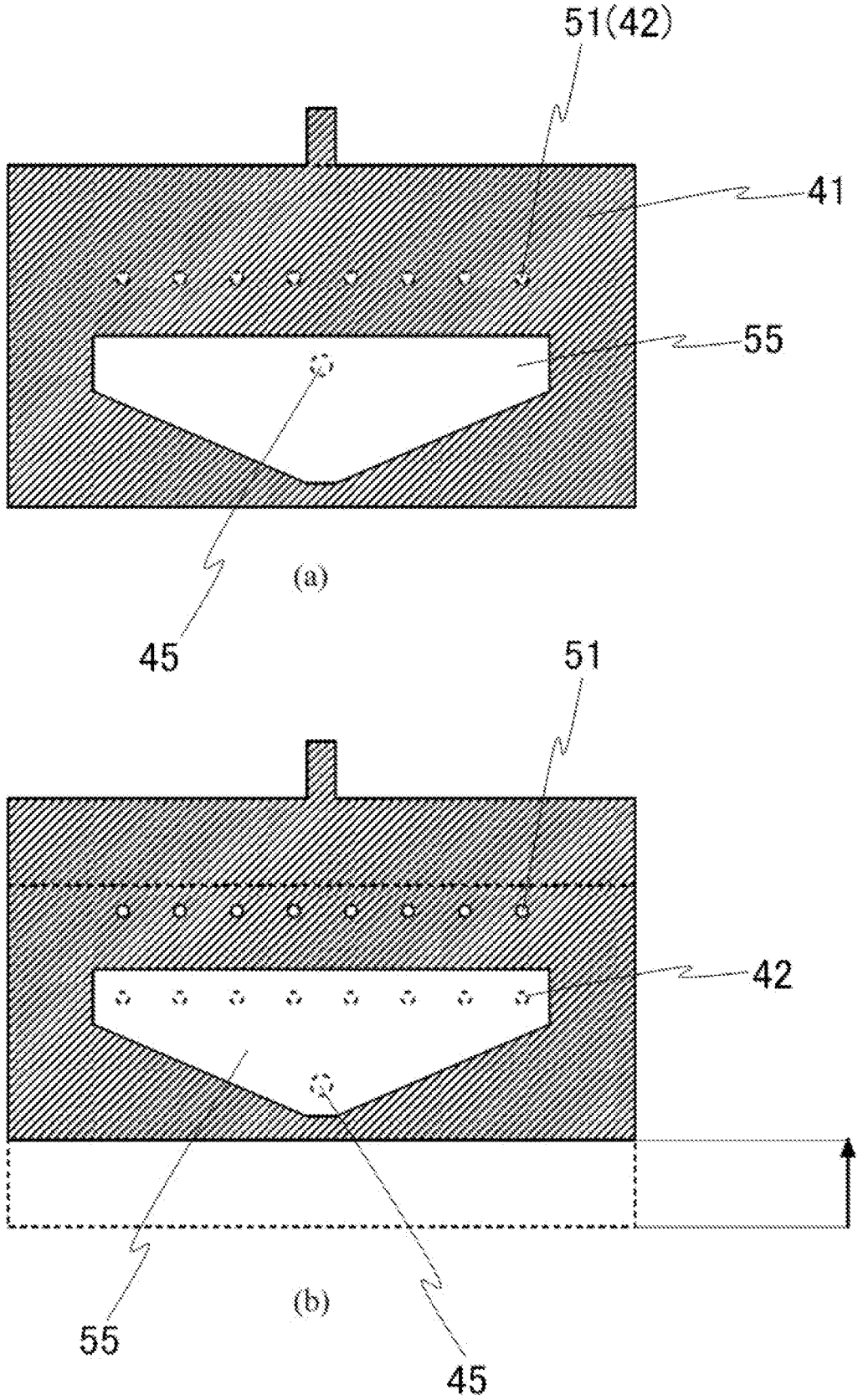

[Fig. 21]
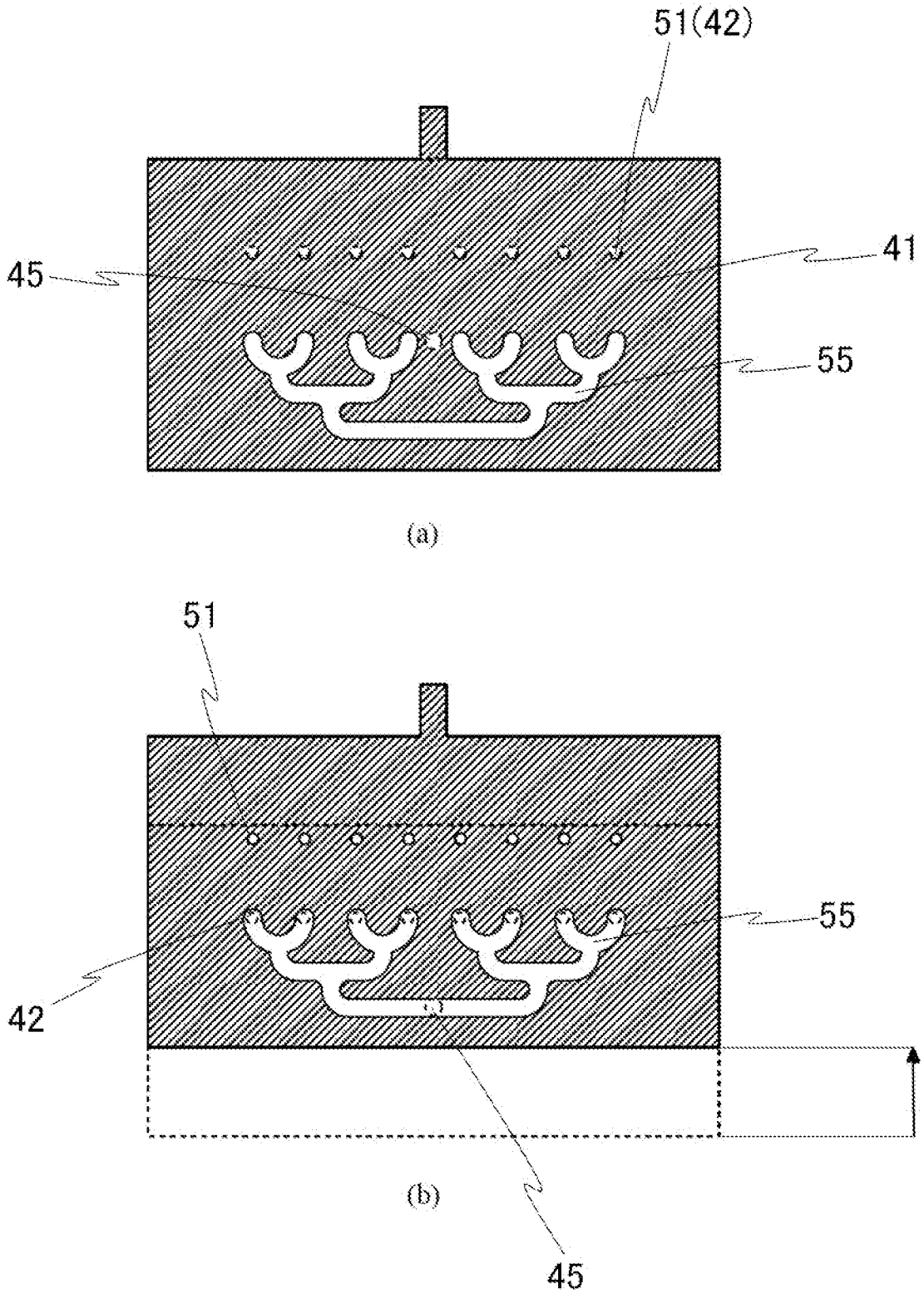

LIQUID MATERIAL DISCHARGE DEVICE, APPLICATION DEVICE PROVIDED WITH SAME LIQUID MATERIAL DISCHARGE DEVICE, AND APPLICATION METHOD USING SAME APPLICATION DEVICE

TECHNICAL FIELD

The present invention relates to a discharge device in which the number of discharge ports and an interval therebetween can be changed depending on uses, and to an application method using the discharge device.

BACKGROUND ART

As a device for dispensing a liquid material in processes for manufacturing electronic parts and so on, there is known a discharge device (dispenser) that discharges the liquid material with a reciprocating plunger.

For example, Patent Document 1 discloses a discharge device in which a plunger is moved to retract for sucking a liquid material into a metering bore, and the plunger is then moved to advance for pushing the liquid material towards a discharge port, thereby discharging the liquid material from the discharge port.

As another example, Patent Document 2 discloses a discharge device including a plurality of plungers. More specifically, there is disclosed a liquid material discharge device including a plurality of metering units disposed adjacent to each other, wherein each of the metering units includes a plunger and a nozzle, and a driver is disposed to move the plurality of plungers such that the plungers advance and retract at the same time. In the disclosed discharge device, the plungers are each fixed to a slider of the plunger driver by a screw.

CITATION LIST

Patent Documents

Patent Document 1: WO2007/046495
Patent Document 2: WO2009/104421

SUMMARY OF INVENTION

Technical Problem

A discharge device including two plungers has been proposed so far. In such a discharge device, however, the interval (pitch) between discharge ports cannot be changed depending on uses. It has also been impossible to change the number of plungers and the number of discharge ports depending on uses. Accordingly, not a few discharge devices have had to be prepared so far depending on the uses.

An object of the present invention is to provide a discharge device in which the number of discharge ports and an interval therebetween can be changed depending on uses, and to provide an application method using the discharge device.

Solution to Problem

The present invention provides a liquid material discharge device comprising a plunger unit provided with three or more plungers; a plunger drive unit for moving the plunger unit in a reciprocating manner; a valve unit including three or more metering bores into which the plungers are inserted, and further including discharge ports and a liquid material supply path that are communicable with the metering bores, the valve unit selectively taking a first position at which the metering bores are communicated with the liquid material supply path and a second position at which the metering bores are communicated with the discharge ports; a valve-unit drive unit for switching over the valve unit between the first and second positions, and a device main body in which the plunger drive unit, the valve unit, and the valve drive unit are arranged, wherein the plunger unit includes a plunger holder for holding the plungers in an aligned state, and the plunger holder is detachably attached to the plunger drive unit.

In the liquid material discharge device described above, the plunger unit may involve a first plunger unit for holding the plungers in an aligned state at a first interval, and a second plunger unit for holding the plungers in an aligned state at a second interval different from the first interval, and selected one of the plunger units may be attached in a detachable manner.

In the liquid material discharge device described above, the plunger unit may involve a first plunger unit for holding three or more plungers in an aligned state, and a second plunger unit for holding a larger number of plungers in an aligned state than the number of plungers held by the first plunger unit, and selected one of the plunger units may be attached in a detachable manner.

In the liquid material discharge device described above, the plunger unit may involve a plunger unit including a plunger holder that holds the plungers aligned in an array of n rows×m columns (where n and m are each an integer equal to 2 or more).

In the liquid material discharge device described above, the valve unit may include a valve member having a recess through which the metering bores are communicated with the liquid material supply path at the first position, and having discharge paths through which the metering bores are communicated with the discharge ports at the second position, and a holing member for holding the valve member in a slidable manner. Moreover, the valve member may include a leakage preventive groove surrounding the recess and the discharge paths. In addition, preferably, the holding member includes one liquid material supply path that is communicated with a liquid material supply source. More preferably, the valve unit includes a nozzle member including the discharge ports that are communicated with the metering bores at the second position, and the valve member is arranged between the nozzle member and the holing member in a slidable manner. In addition, preferably, the device main body includes a valve unit support mechanism for supporting the valve member in a slidable manner and a locking attachment, and the valve unit can be withdrawn and detached from the device main body by releasing the valve unit from a state fixed by the locking attachment.

The present invention provides an application device comprising one of the above-described liquid material discharge devices, a work table on which an application object is placed, an XYZ-direction moving device for relatively moving the liquid material discharge device and the work table, and a control unit for controlling operation of the XYZ-direction moving device.

The present invention provides an application method using the application device, the application method including a step of applying a plurality of patterns, which have the same shape and which are disposed at even intervals, on one work at the same time.

Advantageous Effects of Invention

According to the present invention, the discharge device capable of changing the number of discharge ports and an interval therebetween depending on uses can be obtained.

According to the present invention, the application method of applying a plurality of patterns, which have the same shape and which are disposed at even intervals, on one work at the same time can be obtained.

BRIEF DESCRIPTION OF THE DRAWINGS

FIG. 1 is a front view of a discharge device according to a first embodiment.

FIG. 2 is a side view of the discharge device according to the first embodiment.

FIG. 3 is a front view illustrating a state where plungers are fitted to a plunger holder.

FIG. 4 is a front view of the plunger.

FIG. 5(*a*) is a front view of the plunger holder, and FIG. 5(*b*) is a plan view of the plunger holder.

FIG. 6(*a*) is a front view of a modification of the plunger holder, and FIG. 6(*b*) is a plan view of the modification.

FIG. 7 is a side view illustrating a state where the plungers are fitted to the modified plunger holder.

FIG. 8 is a perspective view referenced to explain a structure of a valve unit.

FIG. 9(*a*) is a perspective view of a valve member, and FIGS. 9(*b*) and 9(*c*) are respectively a horizontal sectional view of the valve member.

FIG. 10(*a*) is a perspective view referenced to explain a modification of the valve member, and FIG. 10(*b*) is a horizontal sectional view of the modification.

FIG. 11(*a*) is a side sectional view illustrating a state where the valve unit takes a first position and the plunger is present at a lowermost position, FIG. 11(*b*) is a side sectional view illustrating a state where the valve unit takes the first position and the plunger is present at an upper position, FIG. 11(*c*) is a side sectional view illustrating a state where the valve unit takes a second position and the plunger is present at the upper position, and FIG. 11(*d*) is a side sectional view illustrating a state where the valve unit takes the second position and the plunger is present at the lowermost position.

FIG. 12 illustrates the valve member in the first embodiment; specifically, FIG. 12(*a*) is a horizontal sectional view referenced to explain a state where the valve member is present at the second position, and FIG. 12(*b*) is a horizontal sectional view referenced to explain a state where the valve member is present at the first position.

FIG. 13 is a front view of an application device equipped with the discharge device according to the first embodiment.

FIG. 14 is a perspective view of the discharge device, in a disassembled state, according to the first embodiment.

FIG. 15 is a front view of the discharge device, the view illustrating a state where engagement pawls on lateral surfaces of the plunger holder are disengaged from locking attachments on an elevating member.

FIG. 16 is a front view of the discharge device, the view illustrating a state where the plunger unit is detached from the elevating member.

FIG. 17 is a front view of the discharge device in a state where a valve unit cover is opened.

FIG. 18 is a front view of the discharge device in a state where the valve unit is detached from the elevating member.

FIG. 19(*a*) illustrates a plunger holder according to a second embodiment, and FIG. 19(*b*) is an exploded perspective view of a valve unit according to the second embodiment.

FIG. 20 illustrates a valve member in a third embodiment; specifically, FIG. 20(*a*) is a horizontal sectional view referenced to explain a state where the valve member is present at the second position, and FIG. 20(*b*) is a horizontal sectional view referenced to explain a state where the valve member is present at the first position.

FIG. 21 illustrates a valve member in a fourth embodiment; specifically, FIG. 21(*a*) is a horizontal sectional view referenced to explain a state where the valve member is present at the second position, and FIG. 21(*b*) is a horizontal sectional view referenced to explain a state where the valve member is present at the first position.

DESCRIPTION OF EMBODIMENTS

In a discharge device of the present invention, a liquid material supplied to a liquid material supply port is sucked into metering bores with retracting movements of three or more plungers, and is discharged from three or more discharge ports at the same time with advancing movements of the plungers subsequent to a valve operation of switching over a flow path.

Although the liquid material is supplied through only one liquid material supply port in the present discharge device, the supplied liquid material is distributed into the three or more metering bores within a discharge unit such that the liquid material can be discharged from the individual discharge ports at the same time, which are present in the same number as that of the metering bores.

Although the discharge device of the present invention includes three or more plungers, those plungers are easy to handle because the plungers are fitted to a plunger holder that defines an interval between the arranged plungers and they are constituted into the form of an integral unit. The discharge device is promptly adaptable for a variety of uses by preparing plunger units including different numbers of plungers or plunger units including plungers fitted thereto at different pitches. Furthermore, the discharge device of the present invention is suitable for applying a plurality of patterns, which have the same shape and which are disposed at even intervals, on one work at the same time. For example, the discharge device is suitable for applying a conduction paste onto a work frame of a semiconductor, or potting a fluorescent material onto a work frame of an LED. In other words, the present invention provides an application device and an application method capable of applying a plurality of patterns, which have the same shape and which are disposed at even intervals, on one work at the same time.

While the required number of plungers is at least three, the number of plungers is preferably not less than four and more preferably not less than five. The plurality of plungers may be arranged side by side in one row or one column, or they may be arranged side by side in plural rows or plural columns. Stated in another way, a number (n×m) of plungers can be mounted (where n and m are each an integer equal to or more than 1 and n×m is 3 or more; preferably n×m is 4 or more, and more preferably it is 5 or more). While a combination of n×m can be optionally changed, it is general that n and m are each an integer equal to or less than 10, and that a value of n×m is equal to or less than 20.

The discharge device of the present invention will be described below in connection with exemplary embodiments.

First Embodiment

<Constitution>

A discharge device 1 according to a first embodiment of the present invention will be described below with reference to FIGS. 1 and 2. In the following description, the side directing towards an observer from the drawing sheet of FIG. 1 (i.e., the left side in FIG. 2) is called the "front", and the side directing away from, the observer from the drawing sheet of FIG. 1 (i.e., the right side in FIG. 2) is called the "rear" in some cases.

The discharge device 1 includes, as main components, a plunger unit 20, a valve unit 40, a plunger drive unit 60, and a valve drive unit 70.

The plunger unit 20 includes eight plungers 21 that are operated to suck or push a liquid material. The eight plungers 21 are arranged at even intervals in a row direction and are fitted to a plunger holder 31. The plunger holder 31 is coupled to an elevating member 63, and the elevating member 63 is fixed at the backside to a slide base 62. The slide base 62 is coupled to a pair of slide rails (not illustrated) disposed on the rear side of a pair of openings 65 that are formed in a front surface of an uprightly-standing device main body 2, and the plungers 21 are moved up and down together with the slide base 62.

The valve unit 40 switches over communication of flow paths between a mode of sucking the liquid material and a mode of discharging the liquid material such that the liquid material is sucked into the discharge device with retracting movement of each plunger, and that the liquid material is discharged with advancing movement of each plunger.

The plunger drive unit 60 includes a drive source, such as a motor or an actuator, for operating the plunger unit 20.

The valve drive unit 70 includes a drive source, such as a motor or an actuator, for operating the valve unit 40.

The above-mentioned components will be described in more detail below.

<Plunger Unit>

As illustrated in FIG. 3, the plunger unit 20 includes the plurality of plungers 21 and the plunger holder 31.

The plungers 21 are inserted into a plurality of metering bores 42 in a one-to-one relation such that each plunger sucks the liquid material into the metering bore with the retracting movement, and that each plunger discharges the liquid material in the metering bore with the advancing movement. The plunger holder 31 holds the specified number of plungers 21 at a predetermined interval therebetween. Preferably, plural types of plunger units 20 are prepared. In other words, it is preferable to prepare plural types of plunger units 20 including the plungers 21 at different pitches and/or in different numbers.

As illustrated in FIG. 4, the plungers 21 are each constituted by a plunger rod 22 having a plunger tail 23 at its backward end. The plunger rod 22 is an elongate columnar member, and the plunger tail 23 is a columnar member having a larger diameter than the plunger rod 22.

An annular seal 24 is fitted over a distal end portion of the plunger rod 22. The seal 24 is not needed to be fitted when a lateral surface of the plunger rod 22 generates a sealing effect in cooperation with an inner wall of a metering member 41, the inner wall defining the metering bore 42. However, the seal 24 is preferably fitted in order to increase accuracy of an amount of the discharged liquid material. The reason is that sliding of the seal 24 in close contact with the inner wall of the metering member 41 prevents the liquid material from leaking through an opening 43 at a top of the metering bore and contributes to increasing the accuracy of the amount of the discharged liquid material.

As illustrated in FIG. 5, two posts 32 are fixed to the plunger holder 31 at positions near both side ends thereof. Respective upper ends of the two posts 32 are coupled to each other by a grip 33. Engagement pawls 34 used for attaching the plunger holder 31 to the elevating member 63 are disposed on both lateral surfaces of the plunger holder 31.

The engagement pawls 34 are, e.g., pawls of a Draw Latch and are engaged with a pair of locking attachments 64, i.e., Draw Latch bodies, which are disposed on both lateral surfaces of the elevating member 63. It is needless to say that the Draw Latch is merely one example, and that the plunger holder 31 and the elevating member 63 may be fixedly coupled to each other by employing any of other suitable detachable connection means.

In the plunger holder 31, plunger insertion bores (36, 37) are formed to extend in a vertical direction in number equal to or larger than the number of the plungers 21 to be held. The plunger insertion bores are each constituted by a small-diameter bore 36 positioned on the lower side and a large-diameter hole 37 positioned on the upper side. The large-diameter hole 37 has substantially the same diameter as that of the plunger tail 23, and a shoulder 25 of the plunger tail 23 abuts against the bottom of the large-diameter hole 37. Stated in another way, the plungers 21 are fixed by engaging the locking attachments 64 on the elevating member 63 with the engagement pawls 34 on the lateral surfaces of the plunger holder 31, and by sandwiching the plunger tail 23 of each plunger between a step, formed at a boundary between the large-diameter hole 37 and the small-diameter bore 36, and a lower surface of the elevating member 63.

The small-diameter bore 36 is formed in a diameter larger than that of the plunger rod 22. When the seal 24 is fitted over the plunger rod 22, the small-diameter bore 36 is formed in a diameter larger than that of the seal 24.

Instead of forming the large-diameter hole 37, the shoulder 25 of the plunger tail 23 may be abutted against the upper surface of the plunger holder 31 from above. In such a case, the small-diameter bore 36 having a smaller diameter than the plunger tail 23 is formed to penetrate through the plunger holder 31, and the plunger 21 is fixed by inserting the plunger rod 22 into the small-diameter bore 36 from the upper side, and by abutting the shoulder 25 of the plunger tail 23 against the upper surface of the plunger holder 31.

FIG. 6(*a*) is a front view of a modification of the plunger holder 31, and FIG. 6(*b*) is a plan view of the modification.

The plunger holder 31 illustrated in FIG. 6 includes guide grooves 35 in number equal to or larger than the number of the plungers 21 to be held. The guide grooves 35 are opened at a lateral surface of the plunger holder 31 on the front side. In an innermost portion of each of the guide grooves 35, there are formed a small-diameter bore 36 positioned on the lower side, and a large-diameter hole 37 positioned on the upper side. The guide groove 35 has a width slightly larger than the diameter of the plunger rod 22. It is to be noted that the width of the guide groove 35 is not needed to be larger than the diameter of the seal 24.

The small-diameter bore 36 has a diameter equal to the width of the guide groove 35, and the innermost portion of the guide groove 35 substantially constitutes the small-diameter bore 36.

The large-diameter hole 37 is formed similarly to that illustrated in FIG. 5, and the shoulder 25 of the plunger tail 23 is abutted against the bottom of the large-diameter hole 37. FIG. 7 is a side view illustrating a state where the plungers 21 are fitted to the plunger holder 31 illustrated in FIG. 6.

<Valve Unit>

FIG. 8 is a perspective view referenced to explain a structure of the valve unit 40. The valve unit 40 includes, as main components, a metering member 41, a holding member 48, and a valve member 50.

The metering member 41 includes metering bores 42 in number equal to or larger than the number of the plungers 21. All the metering bores 42 have the same length.

Preferably, plural types of valve units 40 are prepared to be capable of accepting plural types of plunger units 20. In other words, it is preferable to prepare a plurality of valve units 40 including the metering bores 42 formed at different pitches and/or in different numbers.

The metering bores 42 are each a through-bore penetrating the metering member 41 and the holding member 48. Each metering bore 42 has a metering-bore upper opening 43 opened at an upper surface of the metering member 41, and a metering-bore lower opening 44 opened at a lower surface of the holding member 48. A center-to-center pitch of the metering bores 42 is the same as that of the small-diameter bores 36 formed in the plunger holder 31. In other words, an interval between the metering bores 42 is the same as that between the plungers 21 fitted to the plunger holder 31.

A desired amount of the liquid material is sucked into each of the metering bores 42 with retracting movement of the plunger 21 that is inserted into the metering bore 42 from the metering-bore upper opening 43. In other words, the metering bore 42 sucks or ejects the liquid material in cooperation with the plunger 21 moved to retract or advance.

One liquid material supply path 45 is formed in the metering member 41 and the holding member 48. The liquid material supply path 45 is a through-bore penetrating the metering member 41 and the holding member 48. The liquid material supply path 45 has a supply path inlet 46 opened at the upper surface of the metering member 41, and a supply path outlet 47 opened at the lower surface of the holding member 48.

The holding member 48 in the form of a plate is disposed under the metering member 41. The metering member 41 and the holding member 48 may be fabricated separately and coupled to each other, or may be fabricated in an integral form.

The holding member 48 has a pair of holding portions 49 provided on its lower surface at the right and left sides in a symmetrical relation. The holding portions 49 have L-shaped cross-sections in a widthwise direction, and lateral projections 59 formed at both lateral surfaces of the valve member 50 are allowed to slide into grooves defined by the L-shaped holding portions 49, respectively. In other words, the valve member 50 is slidably held by the holding member 48 in a state where the lateral projections 59 are inserted respectively into the pair of holding portions 49 that are provided at the lower surface of the holding member 48.

FIG. 9(*a*) is a perspective view of the valve member 50, and FIGS. 9(*b*) and 9(*c*) are respectively a horizontal sectional view of the valve member 50.

The valve member 50 includes a plurality of discharge paths 51 opened at its upper surface on the rear side, and a recess 55 formed in its upper surface on the front side.

The discharge paths 51 are each a through-bore extending from the upper surface to a lower surface of the valve member 50. The discharge path 51 has a discharge path inlet 52 opened at the upper surface of the valve member 50, and a discharge port 53 opened at the lower surface of the valve member 50. A lower portion of the discharge path 51 is tapered with a flow path diameter gradually decreasing downwards, and a nozzle 54 having the discharge port 53 is formed at a lower end of the discharge path 51. Preferably, plural types of valve members 50 having the discharge ports 53 with different diameters as shown by FIG. 9(*c*)) are prepared to be adaptable for a variety of uses. Replacement of the valve member 50 is easy because the valve member 50 can be attached and detached just by sliding the valve member 50 to move into and out from the metering member 41.

A center-to-center pitch of the discharge paths 51 formed in the same number as the metering bores 42 is the same as that of the metering bores 42. In other words, the center-to-center pitch of the small-diameter bores 36 formed in the plunger holder 31, the center-to-center pitch of the metering bores 42, and the center-to-center pitch of the discharge paths 51 are all the same.

The recess 55 is a rectangular recess that is formed by cutting the valve member 50 from its upper surface. The recess 55 constitutes, as described later, a supply flow path for communicating the liquid material supply path 45 with all the metering bores 42. The shape of the recess 55 is not limited to the illustrated rectangular shape, and the recess 55 may have any one of substantially triangular, trapezoidal, pentagonal, elliptical, and other suitable shapes in a plan view. Alternatively, the recess 55 may be formed as branched paths. A width of the recess 55 in a right-left direction is larger than the length of a line interconnecting outermost extensions of the discharge paths 51 that are positioned at the right and left ends.

At a rear surface of the valve member 50, there is formed a rear projection 58 having a width smaller than that of the rear surface of the valve member 50 in the right-left direction. The rear projection 58 is a member having a rectangular parallelepiped shape, and a connector 72 of the valve drive unit 70 is coupled to the rear projection 58. When the valve drive unit 70 operates the connector 72 to horizontally advance and retract in a reciprocating manner, the valve member 50 is also horizontally moved in a reciprocating manner relative to the metering member 41. As a result, the valve member 50 takes a first position at which the liquid material supply path 45 is communicated with the metering bores 42, and a second position at which the metering bores 42 in the metering member 41 are communicated with the discharge paths 51 in the valve member 50. When the valve member 50 takes the first position, the recess 55 is positioned to cover an area involving not only the supply path outlet 47, but also all the metering-bore lower openings 44, and the supply path outlet 47 is communicated with all the metering bores 42 (see FIGS. 11(*a*) and 11(*c*)). When the valve member 50 takes the second position, all the metering bores 42 are communicated with the discharge ports 53 through the discharge paths 51, respectively.

FIG. 10(*a*) is a perspective view referenced to explain a modification of the valve member 50, and FIG. 10(*b*) is a horizontal sectional view of the modification. In this modification, an annular leakage preventive groove 56 is formed so as to surround all the discharge paths 51 and the recess 55. Accordingly, even if the liquid material leaks from the discharge paths 51 or the recess 55, the liquid material having leaked is caught in the leakage preventive groove 56.

As an alternative, the valve member 50 may be constituted by two plate-like members stacked one above the other. In the case of such a structure, when the valve member 50 is switched over between the first and second positions, the lower plate-like member (nozzle member) having the discharge ports 53 is not horizontally moved, and only the upper plate-like member (valve member) is moved while sliding in contact with both the metering member 41 and the lower plate-like member (nozzle member). The above structure has an advantage that, because the discharge ports 53 are not horizontally moved, the problem of, e.g., liquid dripping from the discharge ports 53 is less likely to occur.

<Plunger Drive Unit>

The plunger drive unit 60 includes a driver A 61, a slide base 62, and an elevating member 63.

The driver A 61 is a motor, for example, and it serves as a drive source for moving the slide base 62 to reciprocate in an extending direction of the metering bores 42. The elevating member 63 is connected to the slide base 62. The slide base 62 is movable along a pair of elongate openings 65 that extend in the vertical direction.

The locking attachments 64 engageable with the engagement pawls 34 on the plunger holder 31 are disposed on right and left lateral surfaces of the elevating member 63. The plunger holder 31 and the elevating member 63 can be detachably coupled and fixed by engaging the locking attachments 64 on the elevating member 63 with the engagement pawls 34 on the lateral surfaces of the plunger holder 31.

<Valve Drive Unit>

The valve drive unit 70 includes an arm 71, a connector 72, and a driver 73.

The connector 72 is coupled to one end of the arm 71, and the driver 73 is coupled to the other end of the arm 71. The rear projection 58 of the valve member 50 and the arm 71 are detachably coupled and fixed through the connector 72. Therefore, movement of the arm 71 operated by the driver 73 is transmitted to the valve member 50 through the connector 72, and the valve member 50 is moved to slide in a reciprocating manner relative to the metering member 41.

The driver 73 is an actuator, for example, and it moves the arm 71 extending in the horizontal d direction to ad vance or retract relative to the valve unit 40. When the driver 73 moves the arm 71 to retract, the valve unit 40 takes the first position at which the liquid material supply path 45 and the metering bores 42 are communicated with each other. When the driver 73 moves the arm 71 to advance, the valve unit 40 takes the second position at which the metering bores 42 and the discharge ports 53 are communicated with each other. The valve drive unit 70 performs a valve switching operation of the valve unit 40 as described above.

<Operation>

The discharge operation performed using the discharge device 1 will be described below with reference to FIG. 11.

FIG. 11(*a*) illustrates a state where the valve unit 40 takes the first position and the plunger 21 is present at a lowermost position. At the first position, the metering bore 42 is communicated with the liquid material supply path 45 through the recess 55, while the metering bore 42 is disconnected from the discharge port 53. In FIG. 11(*a*), the discharge path 51 is filled with the liquid material, but it is not communicated with the metering bore 42.

FIG. 11(*b*) illustrates a state where the valve unit 40 takes the first position and the plunger 21 is present at an upper position. In other words, FIG. 11(*b*) illustrates a state where the plunger 21 is moved upwards from the state of FIG. 11(*a*) and the liquid material is supplied to the metering bore 42. The upper position of the plunger 21 is variable, and an amount of the liquid material sucked into the metering bore 42 can be adjusted by controlling the driver A 61 and by adjusting a distance through which the plunger 21 is moved upwards. Thus, a desired amount of the liquid material can be sucked into the metering bore 42.

FIG. 11(*c*) illustrates a state where the valve unit 40 takes the second position and the plunger 21 is present at the upper position. More specifically, the valve member 50 is moved to advance from the state of FIG. 11(*b*), whereupon the metering bore 42 is disconnected from the liquid material supply path 45 and the metering bore 42 is communicated with the discharge port 53. The plunger 21 is held at the same position (height) as that illustrated in FIG. 11(*b*).

FIG. 11(*d*) illustrates a state where the valve unit 40 takes the second position and the plunger 21 is present at the lowermost position. In other words, FIG. 11(*d*) illustrates a state where the plunger 21 is moved downwards from the state of FIG. 11(*c*) and the liquid material in the metering bore 42 is discharged. Although, in FIG. 11(*d*), the plunger 21 is moved to the lowermost end and the liquid material in the metering bore 42 is all discharged, the liquid material may be discharged by repeating the downward movement of the plunger 21 while the plunger 21 is stopped once or several times just before reaching the lowermost end of the metering bore 42. Stated in another way, the liquid material in the metering bore 42 can also be discharged in the form of plural divided droplets by controlling the driver A so as to intermittently move the plunger 21 downwards. An amount of the liquid material discharged once from one discharge port 53 is on the order of ng to mg, for example.

The valve member 50 is restored from the state of FIG. 11(*d*) after the end of the discharge operation to the state of FIG. 11(*a*) with the operation of the driver 73 moving the valve member 50 to retract.

The droplets can be repeatedly discharged by successively repeating the states of FIGS. 11(*a*) to 11(*d*). During a period in which the discharge is repeated, the liquid material supply path 45 is always communicated with a liquid supply source (not illustrated), and the liquid material supply path 45 and the recess 55 are always kept in a state filled with the liquid material.

FIG. 12(*a*) is a horizontal sectional view referenced to explain a state where the valve member 50 is present at the second position, and FIG. 12(*b*) is a horizontal sectional view referenced to explain a state where the valve member 50 is present at the first position. As illustrated in FIG. 12(*a*), at the second position, since the discharge paths 51 and the metering bores 42 are communicated with each other, the liquid material in the metering bores 42 can be discharged. As illustrated in FIG. 12(*b*), at the first position, since the metering bores 42 and the liquid material supply path 45 are in a positional relation denoted by dotted lines and are communicated with each other through the recess 55, the liquid material can be sucked into the metering bores 42.

FIG. 13 is a front view of an application device 90 equipped with the discharge device 1.

The application device 90 includes an X-direction moving device 91 capable of moving the discharge device 1 in an X-direction, a Y-direction moving device 92 capable of moving a table 94 in a Y-direction, a Z-direction moving device 93 holding the device main body 2, and a pedestal 95 on which the table 94 is mounted. The XYZ-direction moving devices (91, 92 and 93) are each constituted, for example, by a combination of an electric motor and a ball screw, a mechanism using a linear motor, or a mechanism for transmitting motive power through a belt, a chain, etc.

A work is placed on the table 94, and an applying operation is performed while the discharge device 1 and the table 94 are moved relatively to each other in the XYZ-directions.

<Disassembly>

The components of the discharge device 1 can be disassembled easily.

FIG. 14 is a perspective view of the discharge device 1 in a disassembled state. As illustrated in FIG. 14, in the discharge device 1, the plunger unit 20 and the valve unit 40 can be detached from the device main body. Moreover, the plunger unit 20 can be disassembled into the plunger holder 31 and the plungers 21, and the valve unit 40 can be disassembled into the metering member 41 and the valve member 50. It is to be noted that FIG. 14 illustrates the plunger holder 31 of the type illustrated in FIG. 6 and the valve member 50 of the type illustrated in FIG. 10.

When detaching the plunger unit 20, the elevating member 63 is first moved upwards to withdraw the plungers 21 out of the metering bores 42. In this state, the plunger unit 20 can be detached from the elevating member 63 by unlocking the locking attachments 64 on the elevating member 63 from the state engaged with the engagement pawls 34 on the lateral surfaces of the plunger holder 31. FIG. 15 is a front view of the discharge device 1, the view illustrating a state where the engagement pawls 34 on the lateral surfaces of the plunger holder 31 are disengaged from the locking attachments 64 on the elevating member 63, and FIG. 16 is a front view of the discharge device 1, the view illustrating a state where the plunger unit 20 is detached from the elevating member 63. The Draw Latch (34, 64) disclosed here, by way of example, is convenient in use because it can be latched and unlatched without needing a special tool, e.g., a driver or a wrench.

The valve unit 40 is detached by unlocking a locking attachment 81 from a state engaged with a pawl 82, the locking attachment 81 and the pawl 82 being disposed on a valve unit cover 80. The valve unit cover 80 serves as a locking member to fix a position of the valve unit 40. An end portion of the valve unit cover 80 on the side opposite to the pawl 82 is fixedly held by a hinge 83 to be rotatable. The valve unit 40 is supported by a valve unit support mechanism in a withdrawable manner. More specifically, the valve unit 40 is supported in a withdrawable manner in such a state where a valve unit support 84 supports the lateral projections 59 of the holding member 48 and pins 85 are inserted through holes that are formed in a rear surface of the metering member 41. The valve unit 40 can be detached by rotating the valve unit cover 80 to be opened, and by withdrawing the metering member 41 and the valve member 50. FIG. 17 is a front view of the discharge device 1 in a state where the valve unit cover 80 is opened, and FIG. 18 is a front view of the discharge device 1 in a state where the valve unit 40 is detached from the elevating member 63.

Thus, since the components of the discharge device 1 can be easily disassembled, maintenance operations, such as cleaning, exchange of the liquid material, change of the application conditions, change of the pitch, replacement, and detachment.

According to the discharge device 1 described above, the number of discharge ports and the interval therebetween can be changed by preparing plural types of plunger units 20 and plural types of valve units 40, and by replacing them depending on uses.

Second Embodiment

A discharge device 1 according to a second embodiment is different from the discharge device according to the first embodiment in including sixteen plungers 21, while the other structure is common to both the first and second embodiments. In the following, different points from the first embodiment are mainly described, and description of the structure common to the first embodiment is omitted.

FIG. 19(*a*) illustrates a plunger holder 31 according to the second embodiment, and FIG. 19(*b*) is an exploded perspective view of a valve unit 40 according to the second embodiment.

In the second embodiment, as illustrated in FIG. 19(*a*), sixteen (2 rows×8 columns) large-diameter holes 37 are formed in the plunger holder 31. The large-diameter holes 37 are each constituted similarly to that illustrated in FIGS. 5 and 6. Thus, the shoulder 25 of the plunger tail 23 is abutted against the bottom of the large-diameter hole 37.

As in the case of FIG. 6, the width of a guide groove 35 is slightly larger than the diameter of the plunger rod 22. The eight guide grooves 35 are disposed at the same pitch. The sixteen large-diameter holes 37 are disposed at the same pitch in each of the row direction and the column direction.

As illustrated in FIG. 19(*b*), sixteen metering bores 42 are formed in the metering member 41, and sixteen discharge paths 51 are formed in the valve member 50. The metering bores 42, the discharge paths 51, and the large-diameter holes 37 have the same center-to-center pitch.

Also in the second embodiment, the valve unit 40 takes the above-described first position and second position. When the valve unit 40 takes the first position, the recess 55 is positioned to cover an area involving not only the supply path outlet 47, but also all the metering-bore lower openings 44, and the supply path outlet 47 is communicated with all the metering bores 42. When the valve unit 40 takes the second position, all the metering bores 42 are communicated with the discharge ports 53 through the discharge paths 51, respectively.

As described above, a number (n×m) of plungers 21 (where n and m are each an integer equal to or more than 1 and n×m is 3 or more) can be mounted to the discharge device 1. Optimum mounting of the plungers can be realized depending on uses by preparing the plunger units 20 including the plungers in different numbers and/or at different pitches and the valve units 40 corresponding to those plunger units.

Third Embodiment

A discharge device 1 according to a third embodiment is different from the discharge device according to the first embodiment in that the recess 55 formed in the metering member 41 has a substantially pentagonal shape, while the other structure is common to both the first and third embodiments. In the following, a different point from the first embodiment is mainly described, and description of the structure common to the first embodiment is omitted.

FIG. 20 illustrates a valve member 41 in the third embodiment; specifically, FIG. 20(*a*) is a horizontal sectional view referenced to explain a state where the valve member is present at the second position, and FIG. 20(*b*) is a horizontal sectional view referenced to explain a state where the valve member is present at the first position.

As illustrated in FIG. 20(*a*), at the second position, since the discharge paths 51 and the metering bores 42 are communicated with each other, the liquid material in the metering bores 42 can be discharged. As illustrated in FIG. 20(*b*), at the first position, since the metering bores 42 and the liquid material supply path 45 are in a positional relation denoted by dotted lines and are communicated with each other through the recess 55, the liquid material can be sucked into the metering bores 42.

Thus, even in the case of the recess 55 having the substantially pentagonal shape in a plan view, the object of the present invention can be achieved. With the recess 55 having the substantially pentagonal shape, the amount of the liquid material held in the recess 55 can be reduced in comparison with that in the first embodiment.

Fourth Embodiment

A discharge device 1 according to a third embodiment is different from the discharge device according to the first embodiment in that the recess 55 formed in the metering member 41 has a shape of a branched path, while the other structure is common to both the first and fourth embodiments. In the following, a different point from the first embodiment is mainly described, and description of the structure common to the first embodiment is omitted.

FIG. 21 illustrates a valve member 41 in a fourth embodiment; specifically, FIG. 21(*a*) is a horizontal sectional view referenced to explain a state where the valve member is present at the second position, and FIG. 21(*b*) is a horizontal sectional view referenced to explain a state where the valve member is present at the first position.

As illustrated in FIG. 21(*a*), at the second position, since the discharge paths 51 and the metering bores 42 are communicated with each other, the liquid material in the metering bores 42 can be discharged. As illustrated in FIG. 21(*b*), at the first position, since the metering bores 42 and the liquid material supply path 45 are in a positional relation denoted by dotted lines and are communicated with each other through the recess 55, the liquid material can be sucked into the metering bores 42. When the recess 55 is constituted by the branched path, it is preferable that respective distances from the supply path outlet 47 to the metering-bore lower openings 44 are equal.

Thus, even in the case of the recess 55 being constituted by the branched path, the object of the present invention can be achieved. With the recess 55 being constituted by the branched path, the amount of the liquid material held in the recess 55 can be reduced in comparison with that in the third embodiment.

LIST OF REFERENCE SIGNS

1 discharge device
2 device main body
20 plunger unit
21 plunger
22 plunger rod
23 plunger tail
24 seal
25 shoulder
31 plunger holder
32 post
33 grip
34 pawl
35 groove
36 small-diameter bore
37 large-diameter hole
40 valve unit
41 metering member
42 metering bore
43 metering-bore upper opening
44 metering-bore lower opening
45 liquid material supply path
46 supply path inlet
47 supply path outlet
48 holding member
49 holding portion
50 valve member
51 discharge path
52 discharge path inlet
53 discharge port
54 nozzle
55 recess
56 leakage preventive groove
57 attachment hole
58 rear projection
59 lateral projection
60 plunger drive unit
61 driver A
62 slide base
63 elevating member
64 locking attachment
65 opening
70 valve drive unit
71 arm
72 connector
73 driver
81 locking attachment
82 pawl
83 hinge
84 valve unit support
85 pin
90 application device
91 X-direction moving device
92 Y-direction moving device
93 Z-d direction moving device
94 table
95 pedestal

The invention claimed is:

1. A liquid material discharge device comprising:

a plunger unit provided with three or more plungers;

a plunger driver for moving the plunger unit in a reciprocating manner;

a valve unit including three or more metering bores into which the plungers are inserted, and further including (i) discharge ports configured to discharge a liquid material from inside to outside of the liquid material discharge device and (ii) a liquid material supply path that are communicable with the metering bores, the valve unit selectively taking a first position at which the metering bores are communicated with the liquid material supply path at bottom openings of the metering bores such that the liquid material is supplied through the liquid material supply path into the metering bores from the bottom openings of the metering bores and a second position at which the metering bores are communicated with the discharge ports at the bottom openings of the metering bores;

a valve driver for switching over the valve unit between the first and second positions; and a device main body in which the plunger driver, the valve unit, and the valve driver are arranged, wherein the plunger unit includes a plunger holder for holding the three or more plungers in an aligned state, and the plunger holder is detachably coupled to the plunger driver with the plungers held in the aligned state by the plunger holder, wherein the valve unit includes a valve member having a recess through which the metering bores are communicated with the liquid material supply path at the bottom openings of the metering bores at the first position, and having discharge paths through which the metering bores are communicated with the discharge ports at the bottom openings of the metering bores at the second position, and a valve member holder to hold the valve member in a slidable manner, wherein the device main body includes a valve unit support to support the valve unit and a locking attachment, and the valve unit can be withdrawn and detached from the device main body by releasing the valve unit from a state fixed by the locking attachment, wherein the valve unit includes a metering member in which the three or more metering bores are formed, and one of the plunger unit and the valve unit is detachable in a state where the three or more plungers withdrawn out from the three or more metering bores, and wherein the liquid material supply path is formed in the metering member.

2. The liquid material discharge device according to claim 1, wherein the plunger unit involves a first plunger unit for holding the plungers in an aligned state at a first interval, and a second plunger unit for holding the plungers in an aligned state at a second interval different from the first interval, and selected one of the plunger units is attached in a detachable manner.

3. The liquid material discharge device according to claim 1, wherein the plunger unit involves a first plunger unit for holding three or more plungers in an aligned state, and a second plunger unit for holding a larger number of plungers in an aligned state than the number of plungers held by the first plunger unit, and selected one of the plunger units is attached in a detachable manner.

4. The liquid material discharge device according to claim 1, wherein the plunger unit involves a plunger unit including a plunger holder that holds the plungers aligned in an array of n rows×m columns (where n and m are each an integer equal to 2 or more).

5. The liquid material discharge device according to claim 1, wherein the valve member includes a leakage preventive groove surrounding the recess and the discharge paths.

6. The liquid material discharge device according to claim 1, wherein the valve member holder includes one liquid material supply path that is communicated with a liquid material supply source.

7. The liquid material discharge device according to claim 1, wherein the valve unit includes a nozzle member including the discharge ports that are communicated with the metering bores at the bottom openings of the metering bores at the second position, and the valve member is arranged between the nozzle member and the valve member holder in a slidable manner.

8. The liquid material discharge device according to claim 1, wherein the valve unit involves a first valve member provided with discharge ports each having a first diameter, and a second valve member provided with discharge ports each having a second diameter different from the first diameter, and selected one of the valve members is attached in a detachable manner.

9. The liquid material discharge device according to claim 1, wherein the plunger driver includes an elevator to which the plunger holder is detachably coupled, the liquid material discharge device further includes a locker for coupling the plunger holder and the elevator to each other, and when the plunger holder and the elevator are locked by the locker, backward ends of the three or more plungers are fixedly sandwiched between the plunger holder and the elevator.

10. The liquid material discharge device according to claim 9, wherein the plungers are each constituted by a plunger rod and a plunger tail having a larger diameter than the plunger rod, and the plunger holder has insertion bores or guide grooves each having a diameter larger than the diameter of the plunger rod and smaller than the diameter of the plunger tail.

11. The liquid material discharge device according to claim 1, wherein the plunger driver includes an elevator to which the plunger holder is detachably coupled, the liquid material discharge device further includes a locker for coupling the plunger holder and the elevator to each other, and when the plunger holder and the elevator are locked by the locker, the three or more plungers are fixed.

12. The liquid material discharge device according to claim 11, wherein the plunger holder has insertion bores or guide grooves for holding the three or more plungers in the aligned state, the aligned state implies a state that the three or more plungers are inserted in the insertion bores or are arranged in the guide grooves, and when the plunger holder and the elevator are locked by the locker, the three or more plungers held in the insertion bores or the guide grooves in the aligned state are fixed.

13. The liquid material discharge device according to claim 1, wherein the plunger holder is detachably coupled to the plunger driver by engaging a locking attachment with an engagement pawl.

14. The liquid material discharge device according to claim 13, wherein the engagement pawl and the locking attachment constitute a Draw Latch.

15. The liquid material discharge device according to claim 1, wherein the plunger holder includes a grip.

16. The liquid material discharge device according to claim 15, wherein the grip is disposed at upper ends of posts that are fixed in a state extending upwards relative to the plunger holder, the plunger driver includes an elevator to which the plunger holder is detachably coupled, and when the plunger holder is coupled to the elevator, the grip is positioned above the elevator.

17. The liquid material discharge device according to claim 1, wherein the liquid material is not supplied through top openings of the metering bores at the first position.

18. The liquid material discharge device according to claim 1, wherein the valve unit includes a valve member and a valve member holder to hold the valve member in a movable manner, and the valve unit selectively takes the first position and the second position by moving the valve member relative to the metering bores.

19. An application device comprising:

the liquid material discharge device according to claim 1;

a work table on which an application object is placed;

a mover to relatively move the liquid material discharge device and the work table; and a controller for controlling operation of the mover.

20. An application method using the application device according to claim 19, wherein the application method includes a step of applying a plurality of patterns, which have the same shape and which are disposed at even intervals, on one work at the same time.

* * * * *